US005867760A

United States Patent [19]

Mitsuoka et al.

[11] Patent Number: 5,867,760

[45] Date of Patent: Feb. 2, 1999

[54] TRANSFER DEVICE WITH AN ANISOTROPIN CONDUCTIVE LAYER

[75] Inventors: Tetsunori Mitsuoka, Habikino; Taisuke Kamimura, Kitakatsuragi-gun; Atsushi Inoue, Ikoma-gun; Kazuhiko Furukawa; Keiji Yasuda, both of Tenri, all of Japan

[73] Assignee: Sharp Kabushiki Kaisha, Osaka, Japan

[21] Appl. No.: 916,052

[22] Filed: Aug. 21, 1997

[30] Foreign Application Priority Data

Aug. 29, 1996 [JP] Japan ..... 8-228016

[51] Int. Cl.[6] ..... G03G 15/16

[52] U.S. Cl. ..... 399/313

[58] Field of Search ..... 399/303, 312, 399/313

[56] References Cited

U.S. PATENT DOCUMENTS

| | | | |
|---|---|---|---|
| 4,382,673 | 5/1983 | Nakajima et al. | 399/101 |
| 5,276,490 | 1/1994 | Bartholmae et al. | 399/313 X |
| 5,697,034 | 12/1997 | Iwakura et al. | 399/313 |

FOREIGN PATENT DOCUMENTS

| | | |
|---|---|---|
| 0 568 829 A2 | 11/1993 | European Pat. Off. . |
| 31 11779 A1 | 2/1982 | Germany . |
| 50-32947 | 3/1975 | Japan . |
| 56-110967 A | 9/1981 | Japan . |
| 63-083762 A | 4/1988 | Japan . |
| 1-113771 A | 5/1989 | Japan . |
| 2-046474 A | 2/1990 | Japan . |
| 2-179670 A | 7/1990 | Japan . |
| 5-113725 A | 5/1993 | Japan . |

*Primary Examiner*—S. Lee

*Attorney, Agent, or Firm*—David G. Conlin; George W. Neuner

[57] ABSTRACT

Toner attracted onto an electronic latent image formed on the surface of a photosensitive drum is transferred onto a transfer sheet, using a transfer bias from a transfer bias roller. A transfer belt for transporting the transfer sheet includes an anisotropic conductive layer composed of conductive members and an insulating member. The anisotropic conductive layer is conductive only in the thickness direction thereof and insulating in the other directions. This makes it possible to offer a transfer device that can prevent a transfer electric field from spreading and toner from being projected, and that boasts excellent sheet transportability.

22 Claims, 16 Drawing Sheets

TRANSFER DEVICE WITH AN ANISOTROPIN CONDUCTIVE LAYER

FIELD OF THE INVENTION

The present invention relates to transfer devices used in image forming apparatuses of an electrophotographic method, such as copying machines, laser printers and facsimiles, and more particularly relates to transfer devices for transferring a visual image (hereinafter, will be referred to as a toner image) formed with toner on an image information forming body onto a transfer material in a series of image forming processes.

BACKGROUND OF THE INVENTION

The following description will explain a conventional image forming apparatus of an electrophotographic method. FIG. 14 is a schematic view showing the configuration of a conventional image forming apparatus.

As shown in FIG. 14, the image forming apparatus includes a charging section 91, a developing section 92, a transfer section 93, a cleaning section 94, and a discharging section 95 around a photosensitive drum 90 that is an image information forming body composed of an aluminum base body, etc. whose surface is coated with an organic photoconductive layer (hereinafter, will be referred to as an OPC layer), Se, a-Si, etc.

In the image forming apparatus, as the photosensitive drum 90 rotates in the direction A as shown in FIG. 14, the surface of the photosensitive drum 90 is uniformly charged by corona discharge, etc. of the charging section 91 and then exposed by an exposure section (not shown) composed of an image scanner, an LED, etc. in accordance with image information, thereby forming electronic latent images such as an electrostatic latent image, an electric charge latent image, and a conductive latent image thereon.

Toner 81 including one or two components is supplied from the developing section 92 to the electronic latent image, which is thus visualized and forms a toner image. The toner 81 is charged fine particles colored with carbon black, a pigment, etc., averaging 7 $\mu$m to 15 $\mu$m in particle diameter, and containing a polyester resin, a polypropylene resin, a styrene-acrylic copolymer, etc. as binder resins.

As a transfer sheet 96 that is a transfer material is transported between the photosensitive drum 90 and the transfer section 93 from the right side of FIG. 14 by a paper supply section (not shown), the toner 81 that has formed a visual image on the surface of the photosensitive drum 90 is transferred from the photosensitive drum 90 onto the transfer sheet 96 by corona discharge of the transfer section 93.

The transfer sheet 96 onto which the toner 81 has been transferred is ejected on the left side of FIG. 14 by a paper ejecting section (not shown). The toner 81 is heated and pressed by a fixing section (not shown) to melt, and the image that has been formed with toner on the transfer sheet 96 is fixed.

On the surface of the photosensitive drum 90 after the toner 81 is transferred onto the transfer sheet 96, there remains toner that has not been transferred. This is because not the whole toner image formed on the surface of the photosensitive drum 90 is transferred in the transfer stage where the transfer section 93 transfers the toner 81 onto the transfer sheet 96 in the image forming processes. Normally the toner 81 is transferred onto the transfer sheet 96 at about 80% efficiency with the remaining about 20% being left on the surface of the photosensitive drum 90 as residual toner 82 in the transfer stage. The residual toner 82 is cleaned off the surface of the photosensitive drum 90 by a cleaning section 94.

A cleaning blade made of an elastic member such as urethane rubber, or a fur brush composed of a brush with bristles made of a high polymer organic material, etc. such as nylon and acrylic is used as the cleaning section 94. Cleaning is executed by, for example, the tip of the cleaning blade or an elastic roller that scrapes the residual toner 82 and other adhering substances 83 off the surface of the photosensitive drum 90 when pressed against, or brought into contact with, the surface of the photosensitive drum 90.

The discharging section 95, typically disposed downstream from the cleaning section 94, induces discharging of the surface of the photosensitive drum 90 with light or corona discharge and thus eliminates unnecessary electric charge therefrom.

The image forming apparatus has the above explained configuration. Next, a transfer stage by the transfer section 93 will be explained.

A corona transfer method has been typically employed conventionally with the transfer section 93. According to that method, a transfer electric field is formed by charging the transfer sheet 96 from the backside of the transfer sheet 96 oppositely to the polarity of the toner 81 with corona discharge using a corotron charger, and then the toner 81 is transferred onto the transfer sheet 96 by the Coulomb's force.

However, in recent years, there is a greater interest in other methods, such as a roller transfer method and a belt transfer method, than in the corona transfer method using a corotron charger. According to the roller transfer method, the transfer is carried out by the Coulomb's force, as an elastic roller called a transfer roller provided on the surface thereon with a conductor or dielectric is pressed to the photosensitive drum 90 on the backside of the transfer sheet 96, and then a transfer electric field is formed by applying a bias voltage to the elastic roller (see for instance Japanese Laid-Open Patent Application No. 50-32947/1975 (Tokukaisho 50-32947) and Japanese Laid-Open Patent Application No. 56-110967/1981 (Tokukaisho 56-110967)). According to the belt transfer method, the transfer is carried out by the Coulomb's force as a transfer electric field is formed by charging an endless belt called a transfer belt (see for instance Japanese Laid-Open Patent Application No. 63-83762/1988 (Tokukaisho 63-83762), Japanese Laid-Open Patent Application No. 1-113771/1989 (Tokukaihei 1-113771), and Japanese Laid-Open Patent Application No. 2-46474/1990 (Tokukaihei 2-46474)).

The roller transfer method and the belt transfer method have advantages of creating less ozone than the conventional corona transfer method and of eliminating the need for a discharging section indispensable in the corona transfer method. Especially, as for the belt transfer method, the transfer sheet 96 is attracted toward the transfer belt due to dielectric polarization and preliminary charging and therefore transported while firmly adhering to the transfer belt and contacting with the photosensitive drum 90. The toner image is transferred in that state. Therefore, the transfer belt doubles as a transport section, and the transfer belt is more easily separated from the surface of the photosensitive drum 90 after the transfer is finished than the transfer section of the corona transfer method. Besides, although having a complex structure, the belt transfer method is often used for color image forming apparatuses, etc. because of its high freedom in setting a transfer area.

However, the belt transfer method using the transfer belt has problems: for example, a varying resistance value of the transfer belt depending on the environments, residual electric charges caused by non-uniform properties due to a problem in molding and processing of the belt, and a dirty backside of the transfer sheet 96 due to the residual electric charges (see Japanese Laid-Open Patent Application No. 2-179670/1990 (Tokukaihei 2-179670), and Japanese Laid-Open Patent Application No. 5-113725/1993 (Tokukaihei 5-113725)). Also, since electric charges having the opposite polarity to the toner are separated all of a sudden for example when the transfer sheet 96 enters into the photosensitive drum firm adhesion section and when the transfer sheet 96 is separated from the photosensitive drum 90 after the transfer, abnormal discharge (atmospheric discharge such as detaching discharge) at that time suddenly changes the attraction of the toner to the paper, the toner image on the transfer sheet 96 becomes unstable, and the toner is likely to be projected, resulting in poor quality in the finished image. The toner projection occurs also when the transfer sheet 96 is separated from the transfer belt.

The toner projection may be possibly reduced by the use of a conductive transfer belt (hereinafter, will be referred to as a conductive belt). However, the conductive belt has a low surface resistance and exhibits large electric charge leak in the surface plane of the transfer belt in a very humid and hot environment, adversely affecting transfer properties.

Also, as shown in FIG. 15, if there exists a pin-hole 90*b* in an OPC layer 90*a* of a photosensitive drum 90 facing a transfer belt 100 while a bias is being applied to the transfer belt 100, the electric charge in quite a large area around the pin-hole 90*b* flows from the transfer belt 100 to the aluminum base body 90*c* of the photosensitive drum 90 through the pin-hole 90*b*. The transfer belt 100 is therefore in a quasi-grounded state. The area around the pin-hole 90*b* is discharged, failing to form a transfer electric field and to transfer the toner 81 onto a transfer material. Especially, when using a transfer belt 100 having low surface and volume resistivities, a very large area extending in a direction perpendicular to the paper transporting direction (in a direction perpendicular to the transport direction of the transfer belt 100, that is, in the same direction as the direction of the shaft of the photosensitive drum 90) turns into the above-mentioned quasi-grounded state on the instant when the transfer is to be carried out to the place where the pin-hole 90*b* occurs. Resultant problems include failure in transfer due to weakening of the transfer electric field across that area, and electric current flowing in excess into the aluminum base body 90*c* of the photosensitive drum 90 through the pin-hole 90*b*.

In addition, the transfer sheet is well attracted if a dielectric belt with a high resistivity is used. However, if a conductive belt is used, the belt is charged for an extremely short period of time, and accordingly the transfer sheet is attracted for a shorter period of time. Therefore, there occurs a problem in paper transportation.

SUMMARY OF THE INVENTION

In view of the problems, an object of the present invention is to offer a transfer device that can prevent a transfer electric field from spreading and toner from being projected, and that boasts excellent sheet transportability.

In order to accomplish the object, a transfer device in accordance with the present invention, incorporated in an image forming apparatus for forming an image with an electrophotographic method, is for transferring an image on an image information forming body onto a transfer material by applying a transfer bias with a transfer bias application section while attracting and transporting the transfer material with a belt member, the belt member being provided with an anisotropic conductive layer that is conductive only in a thickness direction of the belt member and insulating in the other directions.

In the transfer device, a belt member with an anisotropic conductive layer having a property called anisotropic conductance that shows conductance in a thickness direction and insulation in the other directions is used as the belt member. Therefore, it is possible to prevent a transfer bias applied by the transfer bias application section from spreading out to the surrounding area of the transfer area, and toner from being projected. It is also possible to reduce affection of inappropriate transfer caused by a pin-hole that exists on an image information forming body.

For a fuller understanding of the nature and advantages of the invention, reference should be made to the ensuing detailed description taken in conjunction with the accompanying drawings.

DESCRIPTION OF THE EMBODIMENT

The following description will discuss an embodiment in accordance with the present invention.

[Configuration of Image Forming Apparatus]

Figure 2:
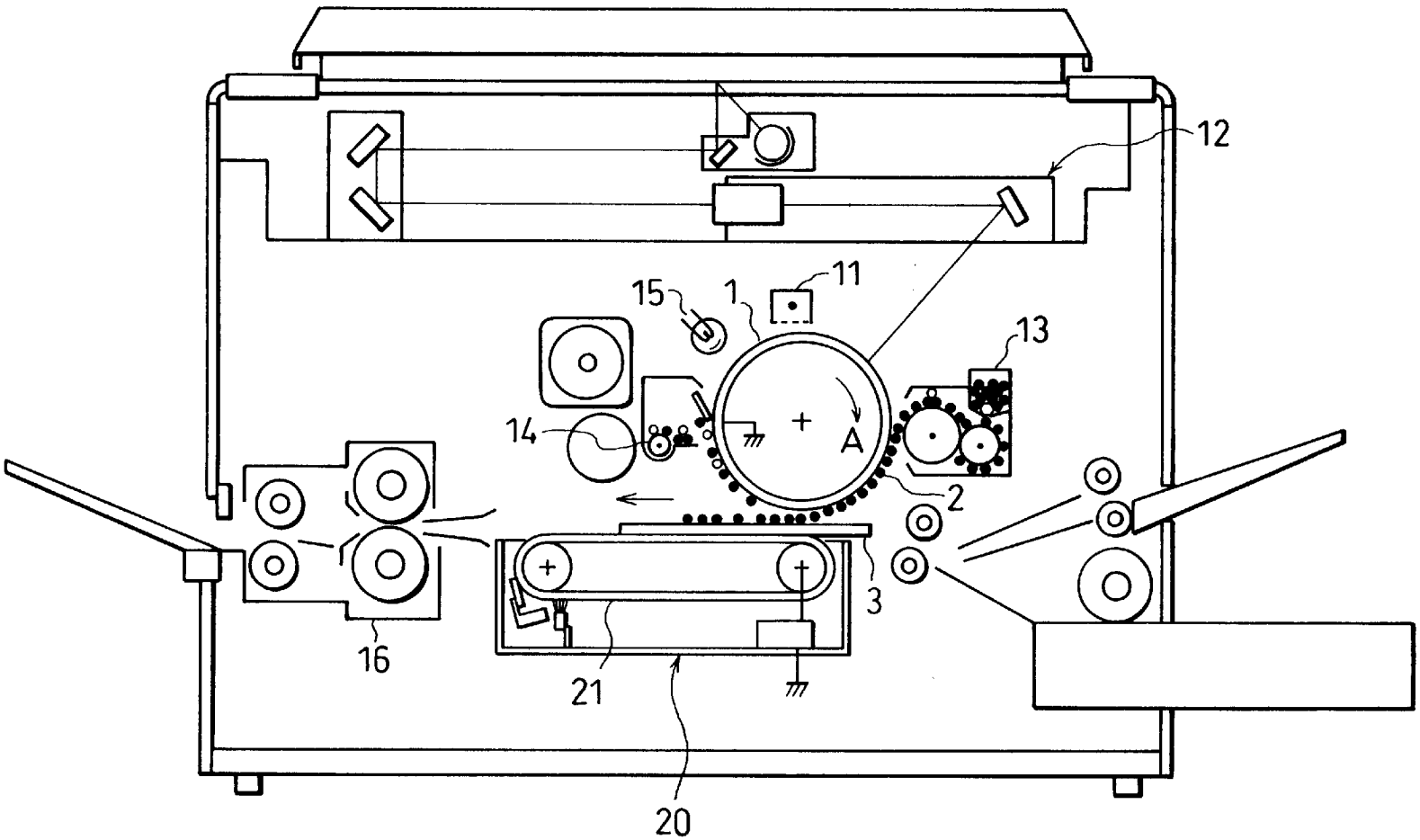
FIG. 2 is a view schematically showing a configuration of an image forming apparatus incorporating the transfer device.

FIG. 2 is a view schematically showing a configuration of an image forming apparatus incorporating the transfer device of the present embodiment. The image forming apparatus forms an image with toner 2, i.e. a toner image, on a photosensitive drum 1 that is an image information forming body with an electrophotographic method and transfers the toner image onto a transfer sheet 3 that is a transfer material, using a transfer device 20 in accordance with the present invention.

The image forming apparatus includes a charging device 11, an exposure device 12, a developing device 13, a transfer device 20, a cleaning device 14, a discharging device 15, and a fixing device 16 around the photosensitive drum 1 composed of an aluminum base body, etc. whose surface is coated with an OPC layer, Se, a-Si, etc.

As the photosensitive drum 1 rotates in the direction indicated by the arrow A in FIG. 2, the surface of the photosensitive drum 1 is uniformly charged by corona discharge, etc. of the charging device 11 and then exposed by the exposure device 12 composed of an image scanner, an LED, etc. (not shown) in accordance with image information, thereby forming an electronic latent image thereon.

Toner 2 including one or two components is supplied from the developing device 13 to the electronic latent image, which is thus visualized by the toner 2 and forms a toner image. The toner 2 is charged fine particles colored with carbon black, a pigment, etc., averaging 7 $\mu$m to 15 $\mu$m in particle diameter, and containing a polyester resin, a polypropylene resin, a styrene-acrylic copolymer, etc. as binder resins.

The transfer sheet 3 is transported between the photosensitive drum 1 and the transfer device 20 from the right side of FIG. 2 by a paper supply device. The toner 2 forming a visual image on the surface of the photosensitive drum 1 is transferred from the photosensitive drum 1 onto the transfer sheet 3 by the transfer electric field formed by a transfer bias of the transfer device 20.

The transfer sheet 3 onto which the toner 2 has been transferred is transported toward the left side of FIG. 2 by a transfer belt 21 that is a belt member of the transfer device 20 that double-functions and transports the sheet. The toner 2 is heated and pressed by a fixing device 16 to melt, and the image that has been formed with toner 2 on the transfer sheet 3 is fixed.

The toner image formed on the surface of the photosensitive drum 1 is transferred onto the transfer sheet 3 at about 80% to 90% efficiency by the transfer device 20 with the rest remaining on the surface of the photosensitive drum 1 as residual toner in a transfer stage of transferring the toner 2 onto the transfer sheet 3 in the image forming processes.

The cleaning device 14 removes the residual toner from the surface of the photosensitive drum 1. The cleaning device 14 includes a cleaning member, for example, a cleaning blade made of an elastic member such as urethane rubber, or a fur brush composed of a brush with bristles made of high polymer organic materials, etc. such as nylon and acrylic. Cleaning is executed by the tip of the cleaning member that removes the residual toner and other adhering substances from the surface of the photosensitive drum 1 when pressed against, or brought into contact with, the surface of the photosensitive drum 1. Alternatively, cleaning is executed by the elastic roller that removes the residual toner and other adhering substances from the surface of the photosensitive drum 1 when pressed against, or brought into contact with, the surface of the photosensitive drum 1. Even another method of removing the residual toner and other adhering substances from the surface of the photosensitive drum 1 is to bring closer a roller to which a bias volt age is being applied and then to apply an electric field formed by that bias voltage.

The photosensitive drum 1 after having passed through the cleaning device 14 is irradiated with, for instance, light radiating from the discharging device 15. Hence, the photosensitive drum 1 is discharged, and then a next image forming process is carried out.

[Configuration of Transfer Devices]

The image forming apparatus has its feature in a transfer device for transferring charged fine particles onto a transfer material on which an image is formed. The following description will explain the transfer device.

The transfer device of the present embodiment carry out the transfer with the above-mentioned belt transfer method, and is provided with the transfer belt 21 that is a belt member that including an anisotropic conductive layer (a member conductive only in the thickness direction of the transfer belt 21 and insulating in directions perpendicular thereto).

Figure 3:
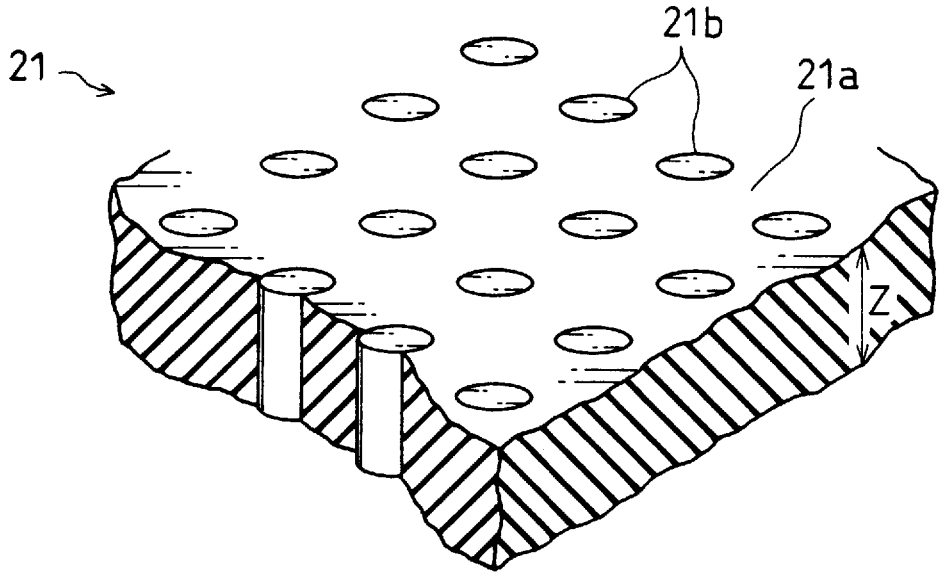
FIG. 3 is an explanatory view showing a structure of a transfer belt used in the transfer device.

An example of the anisotropic conductive layer is made up of an insulating member 21*a* and conductive members 21*b*, the conductive members 21*b* being scattered in a standing manner at equal intervals in the insulating member 21*a* as shown in FIG. 3. The insulating member 21*a* is composed of an insulating material: for example, a high polymer organic material such as silicon, urethane, polyethylene, polyimide, polycarbonate, polyfluorovinylidene, or polyethylene terephthalate. The conductive members 21*b* are composed of, for example, conductive fine particles, conductive filler, or conductive fiber, and more specifically, carbon fiber or metal wire. The anisotropic conductive layer will be provided with good conductance only in the thickness direction thereof and good insulation in directions parallel to the belt surface, for example, by such an arrangement that the longitudinal direction of the conductive members 21*b* practically conform to the thickness direction (direction indicated by the arrow Z in FIG. 3) of the insulating member 21*a*, or by depositing the conductive members 21*b* in the thickness direction of the insulating member 21*a* so that the conductive members 21*b* are scattered and do not contact with one another in the directions (the belt moving direction and the longitudinal direction of the photosensitive body; hereinafter will be referred to as the belt surface directions) perpendicular to the thickness direction.

Figure 1:
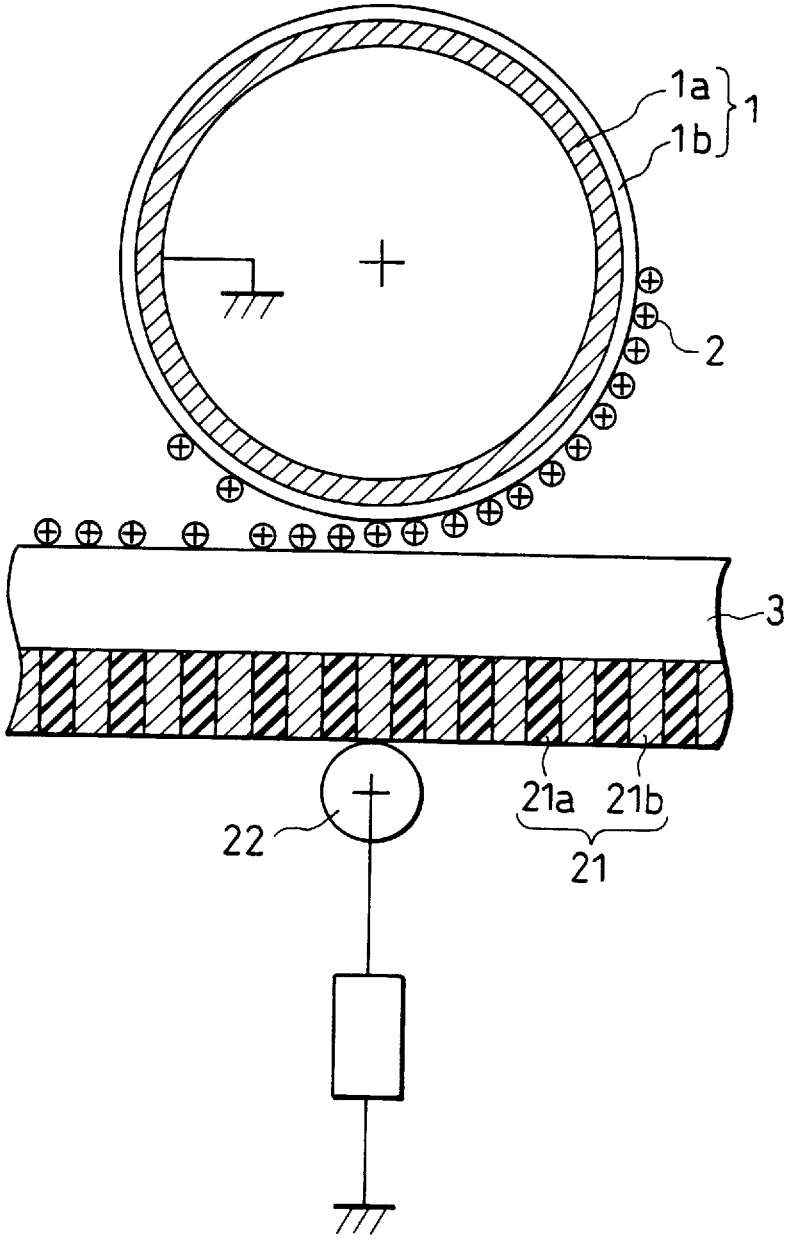
FIG. 1 is a view schematically showing a configuration of a transfer section in a transfer device of an embodiment in accordance with the present invention.

FIG. 1 illustrates the transfer operation by the transfer device using the transfer belt 21 having such an anisotropic conductive layer. As for the image forming apparatus of a transfer belt method, the transfer bias applied during transfer is first applied to a transfer bias roller 22 that is a transfer bias application section and further applied to the backside of the transfer sheet 3 by a conductive member 21*b* at the transfer position where the transfer belt 21 contacts with the photosensitive drum 1. Then, the toner 2 that is charged fine particles is transferred onto the transfer sheet 3 by the effect of the transfer electric field formed by the transfer bias.

Here, the transfer bias is directly applied to the conductive member 21*b* at the transfer position, and the rest of the transfer belt 21 is less affected by the bias application because of its anisotropic conductance (the insulating property of the transfer belt 21 in the belt surface directions). In other words, the transfer bias has an effect only in a limited area (transfer area) where the transfer belt 21 contacts with the photosensitive drum 1. Therefore, the transfer bias has an effect between the photosensitive drum 1 and the conductive members 21*b* in a concentrated manner due to the conductive members 21*b* in the transfer area. The concentrated effect can restrain projection of the toner during transfer.

As described above, since the transfer belt 21 has the anisotropic conductive layer on its contact surface with the transfer sheet 3, the transfer device of the present embodiment can both effectively let the transfer electric field have an effect and form no needless electric field across a paper inserting section located upstream from the transfer area and across a paper ejecting section located downstream from the transfer area, thereby eliminating toner projection.

In addition, it is made possible to discharge an arbitrary segment of the surface of the transfer belt 21 by the use of the anisotropic conductive layer as the transfer belt 21. That is, needless residual electric charges can be removed by bringing a contact member for discharge into contact with the arbitrary segment of the transfer belt 21 and applying a bias voltage to, or grounding, the transfer belt 21. It is also made possible to let rollers of a belt driving section retain the function of driving the belt and have additional functions as bias application rollers and discharging rollers for removing the residual electric charges.

Figure 4:
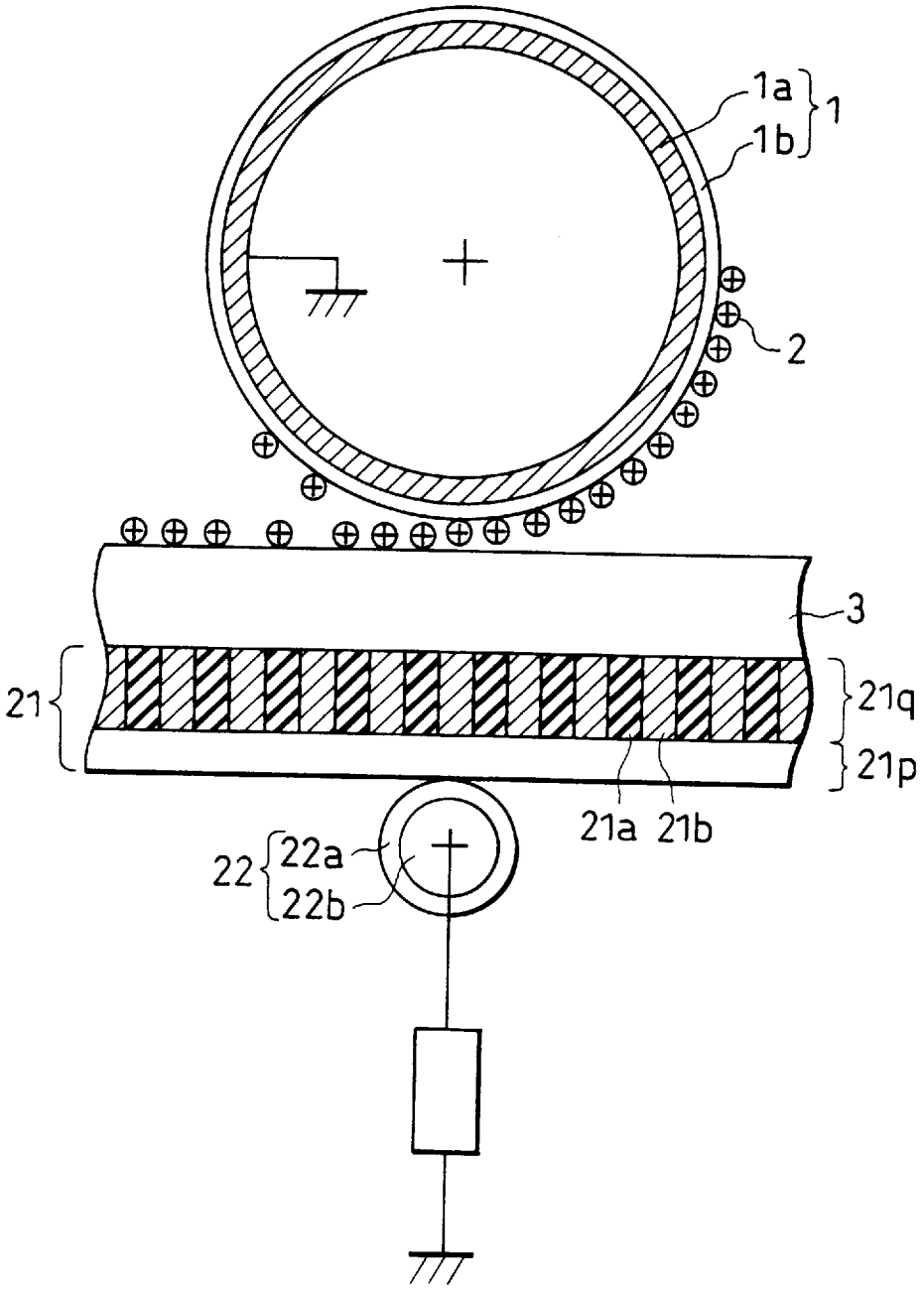
FIG. 4 is a view schematically showing a configuration, different from that in FIG. 1, of the transfer section in the transfer device.
Figure 5:
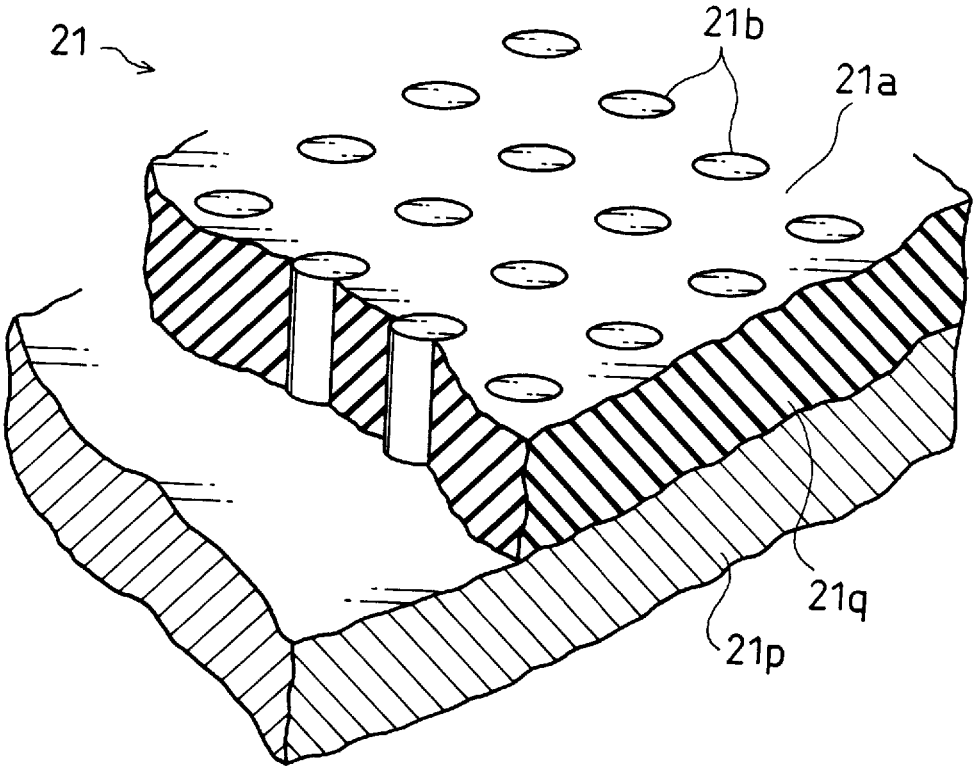
FIG. 5 is an explanatory view showing a structure of a transfer belt used in the transfer device shown in FIG. 4.

FIG. 4 shows a different configuration of a transfer device using the transfer belt 21 having the anisotropic conductive layer. FIG. 5 is an enlarged view of the transfer belt 21 of this transfer device. As shown in FIGS. 4 and 5, here, the transfer belt 21 is composed of a conductive layer 21*p* and an anisotropic conductive layer 21*q*. The anisotropic conductive layer 21*q* is formed on the conductive layer 21*p* and composed of conductive members 21*b* and an insulating member 21*a*. According to the configuration, the conductive member 21*b* at the transfer position where the transfer belt 21 contacts with the photosensitive drum 1 also allows the transfer bias to be applied in a concentrated manner to the backside of the transfer sheet 3 and the toner 2 to be transferred onto the transfer sheet 3 without being projected. Besides, since the configuration generates an electric field across the transfer belt 21 outside, as well as inside, the transfer area (area to which the transfer bias is applied), the transfer sheet 3 can be electrostatically attracted, and the transfer operation can be stably carried out.

FIRST EXAMPLE

Figure 6:
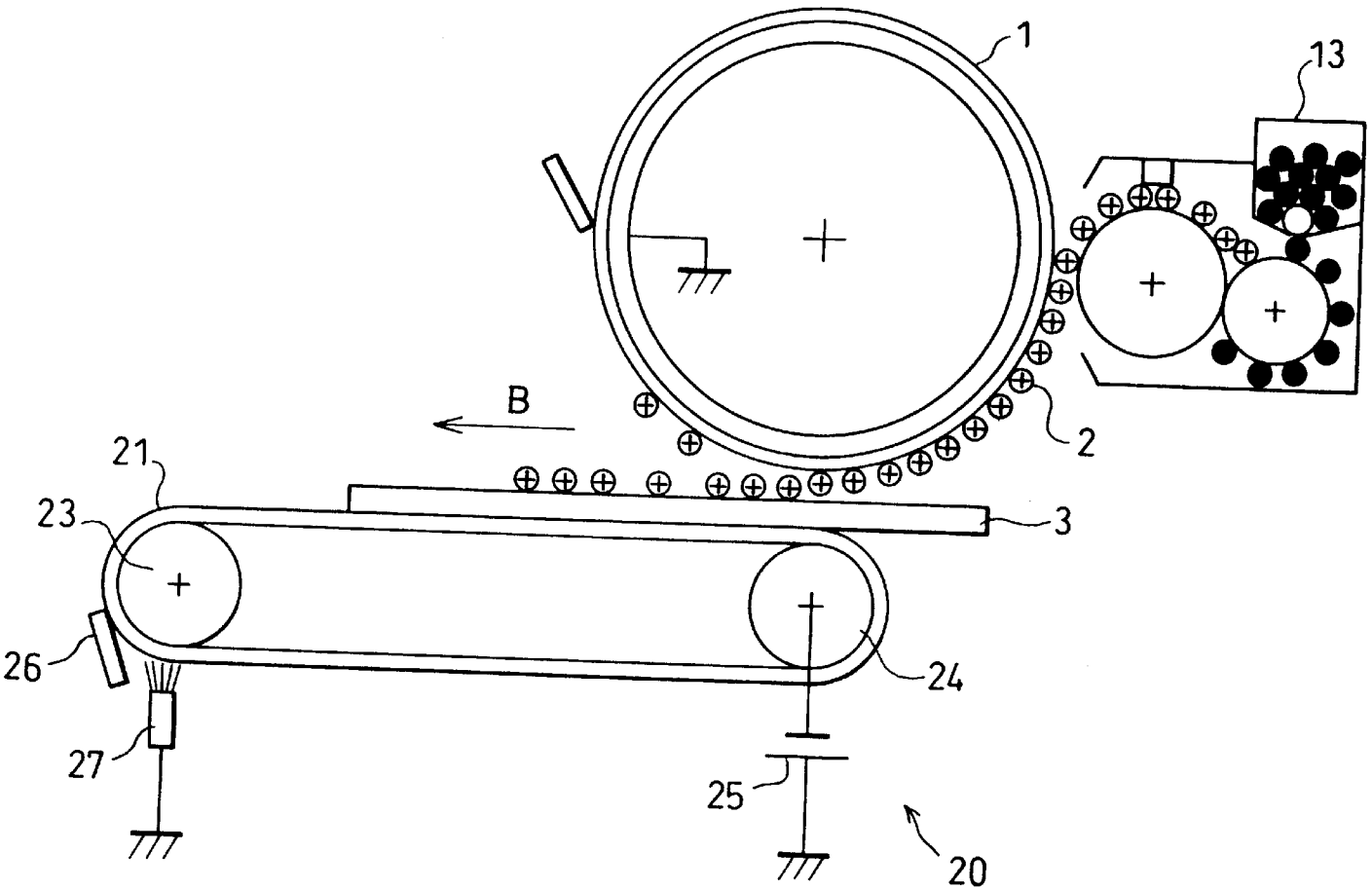
FIG. 6 is a view schematically showing a configuration of a transfer device of a first example.

FIG. 6 is an enlarged view showing a transfer device of the present example. Referring to FIG. 6, the following description will explain the transfer device. The transfer device uses the transfer belt 21 shown in FIG. 3 as a belt member. A driving roller (second roller) 23 and an auxiliary roller (first roller) 24, both measuring 15 mm in diameter and 328 mm in length, are each provided with a shaft by which those rollers are supported.

The interval between the shafts of the driving roller 23 and the auxiliary roller 24 is 145 mm (hereinafter will be referred to as the transfer belt shaft interval). The transfer belt 21 is disposed so as to stretch between the two rollers. Here, since the driving roller 23 is located downstream from the auxiliary roller 24 as shown in FIG. 6, the transfer belt 21 is driven stably without being stuck. The rotating speed of the transfer belt 21 (i.e., the moving speed of the transfer material) can be arbitrarily set in a range of, for example, 20 mm/s to 1000 mm/s by varying the rotation driving force transmitted from a driving system and changing the rotating speed of the driving roller. The inventors normally uses rotating speeds ranging from 100 mm/s to 500 mm/s, and in this example sets the rotating speed to about 220 mm/s.

The transfer device 20 supports the transfer belt 21 with a transfer belt pressing and separating device, for example a pressure applying mechanism including an adjusting mechanism (not shown), in order to bring the transfer belt 21 into contact with the photosensitive drum 1 at a constant pressure. The dimensions of the transfer belt 21, although varying among the actual designs, are for instance 337 mm in inner circular length, 330 mm in width and 0.5 mm in thickness.

The arrangement of the conductive members 21*b* is preferably determined according to dot intervals of the image formed on the transfer sheet 3. Specifically, the configuration of the transfer belt 21 is preferably determined so that there is always a conductive member 21*b* at a position facing the toner 2 on the photosensitive drum 1. By this configuration, the transfer belt 21 attracts the toner 2 with almost the same strength regardless of the position of the photosensitive drum 1, restraining non-uniformity which occurs to images formed on the transfer sheet 3.

The auxiliary roller 24 is located almost right beneath the position where the transfer belt 21 contacts with the photosensitive drum 1 via the transfer sheet 3. A transfer bias of, for example, −1 kV is applied to the auxiliary roller 24 by a transfer bias power supply device 25 with, for example, constant voltage control. In other words, in the present example, a transfer bias application section is composed of the auxiliary roller 24 and the transfer bias power supply device 25. The toner 2 on the photosensitive drum 1 is transferred onto the transfer sheet 3 by the effect of the electric field formed by the transfer bias. The transfer bias is supplied to the auxiliary roller 24 by the transfer bias power supply device 25 as the contact member made of, for example, phosphor bronze that slides well and that boasts high conductance touches, and slides against, the auxiliary roller 24.

The driving roller 23 is driven to rotate anti-clockwise by a belt driving system (not shown). The transfer belt 21 rotates because of the friction with the driving roller 23, tension has an effect on the upper portion (the portion on which the transfer sheet is transported after transfer) of the transfer belt, the upper portion of the transfer belt moves along the paper transporting direction (the direction indicated by the arrow B in FIG. 6), and the transfer sheet 3 is transported to the fixing device (not shown). The provision of an elastic layer 23*a* on the surface of the driving roller 23 will allow the transfer belt 21 to stretch between, and stably run around, the driving roller 23 and the auxiliary roller 24.

At the transfer position of the transfer belt 21 oppositely facing the photosensitive drum 1, the transfer bias applied by the transfer bias power supply device 25 has an effect on the auxiliary roller 24. As the transfer bias is applied between the photosensitive drum 1 and the auxiliary roller 24, a bias of the same strength as that of the transfer bias applied to the auxiliary roller 24 is also applied to the conductive member 21*b* of the transfer belt 21 that is in contact with the auxiliary roller 24.

In such a state, the transfer electric field contributing to transfer is formed not only by the auxiliary roller 24 but also by the conductive member 21*b* of the transfer belt 21 having the anisotropic conductive layer. The transfer belt 21 used here is such a type that the longitudinal direction of the conductive members 21*b* conforms to the thickness direction of the transfer belt 21.

When the conductive member 21*b* that is in contact with the auxiliary roller 24 receives the transfer bias from the auxiliary roller 24 and gives the transfer bias to the backside (the side that is in contact with the transfer belt 21) of the transfer sheet 3 at the transfer position, if the conductive members 21*b* are properly arranged, the transfer bias has an effect only on a portion approximately corresponding to the nip width where the transfer belt 21 contacts with the auxiliary roller 24. Then, the toner 2 in the portion that is in contact with the transfer belt 21 and the photosensitive drum 1 in the portion corresponding to the nip width is transferred from the photosensitive drum 1 onto the transfer sheet 3 by the effect of the transfer electric field. The nip width is determined so as to desirably carrying out the transfer.

The transfer sheet 3 onto which the toner 2 has been transferred is transported in the paper transporting direction and enters the fixing device (not shown), while being attracted onto the transfer belt 21 by the effect of, for instance, the insulating member 21*a* that is partially dielectrically polarized. Upon entering the fixing device, the transfer sheet 3 on the transfer belt 21 is detached from the transfer belt 21 due to the curvature of a portion where the transfer belt 21 is supported by the driving roller 23.

The toner 2, paper powder, etc. unnecessarily adhering to the surface of the transfer belt 21 from which the transfer sheet 3 has been detached is cleaned by a cleaning member 26 composed of, for example, a cleaning blade or a cleaning roller belt. Thereafter, a belt discharging device 27 composed of a discharging brush, a discharging roller, etc. is brought into contact with, and discharges, the surface of the transfer belt 21 in order to completely removing the residual electric charges on the surface of the transfer belt 21.

Figure 7:
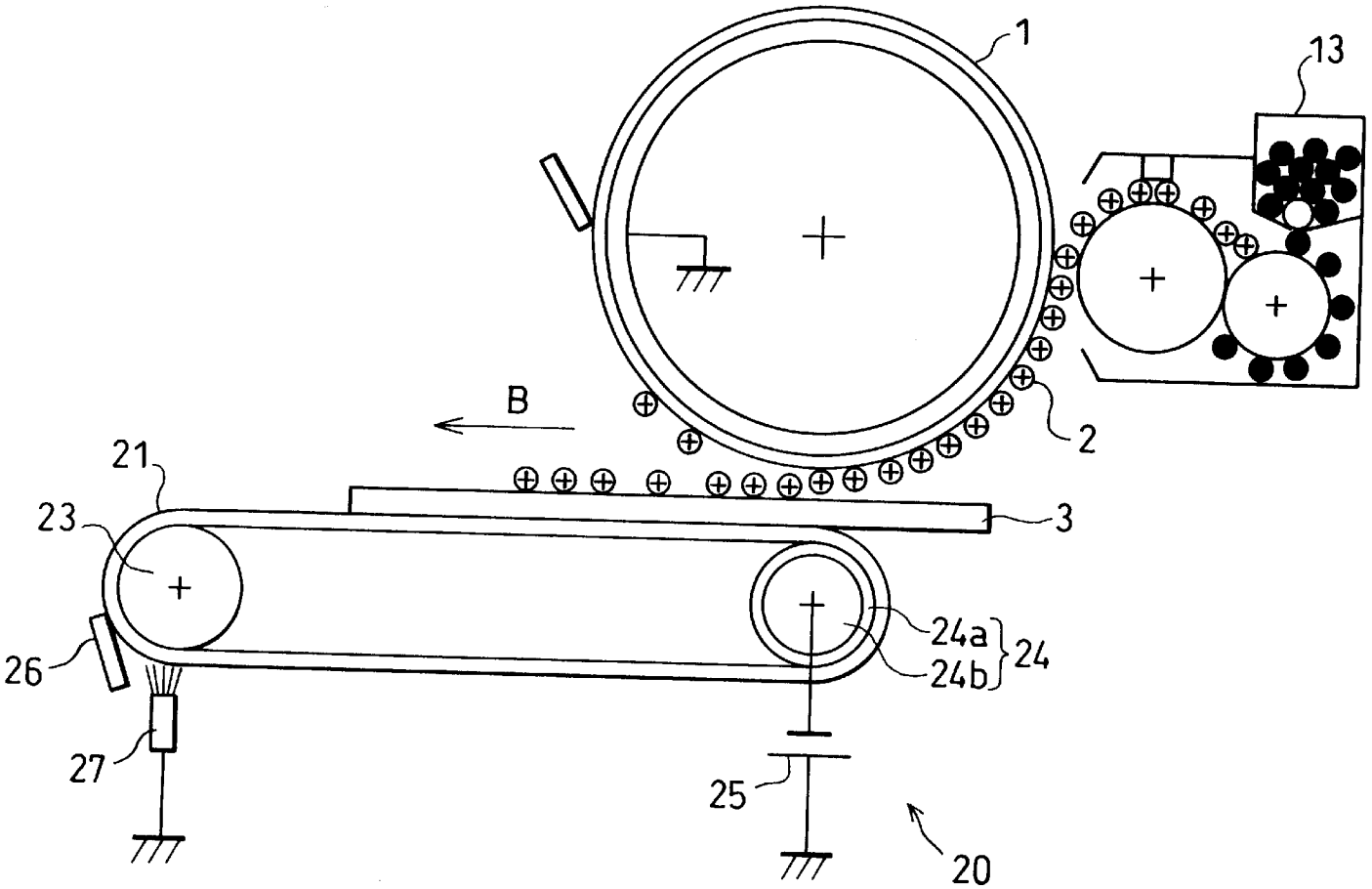
FIG. 7 is a view schematically showing another configuration of a transfer device of the first example.

The configuration described above is a mere example. The effects of forming the transfer belt 21 with the anisotropic conductive layer are retained even if a partial change is made in configuration, such as material, dimension and arrangement. For example, as shown in FIG. 7, the auxiliary roller 24 may have such a configuration that a dielectric layer 24*a* is formed on the surface of the conductive members 24*b*. In this case, the dielectric layer 24*a* functions also as a protection layer against an excessive electric current flowing for some reason.

Also, the photosensitive drum 1 is in contact with the transfer belt 21 via the transfer sheet 3 in the present example. However, alternatively, the photosensitive drum 1 may be disposed to oppositely face the transfer belt 21 with an empty space provided therebetween.

A good image can be formed on a transfer sheet 3, and a transfer device with good transfer properties can be offered, by forming the transfer belt 21 with the anisotropic conductive layer that is conductive in the thickness direction thereof and insulating in the belt surface directions as described above.

Besides, if the auxiliary roller 24, to which the transfer bias is applied, is configured so that the dielectric layer 24*a* is formed on the surface of the conductive member 24*b*, it is possible to restrain, for example, destruction even when a current flows in excess for some reason.

Besides, if the driving roller 23 disposed on the downstream side of the two rollers which are located at the two ends of the transfer belt 21 and between which the transfer belt 21 stretches is structured so as to have the elastic layer on the surface thereof, it is possible to stably drive the transfer belt 21 stretching between the rollers.

Besides, since the conductive members 21*b* composing the transfer belt 21 having anisotropic conductance are arranged according to the dot pitches of the image formed on the transfer sheet 3, the toner 2 is attracted from photosensitive drum 1 toward the transfer sheet 3 with almost the same strength in all the area of the transfer sheet 3, non-uniformity is eliminated from the image, improving quality of the image.

Moreover, the transfer electric field can be concentrated in the transfer area, and toner projection can be prevented, by making the width of the conductive members 21*b*, in the transport direction, which composes the transfer belt 21 having anisotropic conductance almost equal to the contact width of the transfer belt 21 and the auxiliary roller 24 that is the transfer bias application section.

SECOND EXAMPLE

Figure 8:
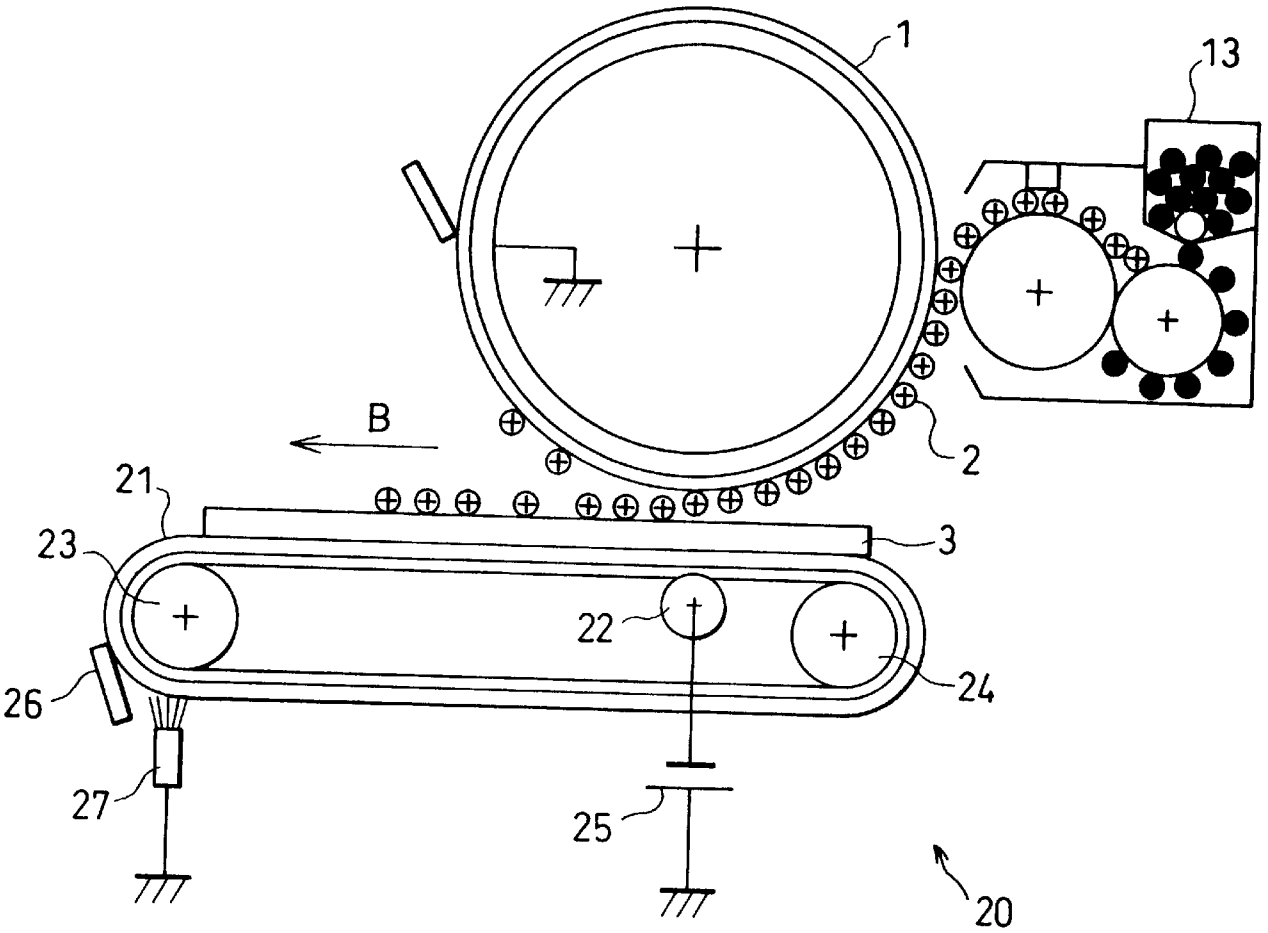
FIG. 8 is a view schematically showing a configuration of a transfer device of a second example.

FIG. 8 schematically shows a configuration of a transfer device of the second example. Referring to FIG. 8, the following description will explain the transfer device.

Since the transfer device 20 of the present example has basic operations and configuration that are similar to those of the first example, the following description will focus on features of the configuration.

In the transfer device 20, the transfer bias roller 22 to which the transfer bias is applied is located almost right beneath the position where the transfer belt 21 contacts with the photosensitive drum 1 via the transfer sheet 3. The driving roller 23 and the auxiliary roller 24 both measure 14 mm in diameter and 330 mm in length. The transfer bias roller 22 measures 6 mm in diameter and is made of aluminum. The driving roller 23, the auxiliary roller 24 and the transfer bias roller 22 are each provided with a shaft by which those rollers are supported.

The shaft interval between the shafts of the driving roller 23 and the auxiliary roller 24 is 150 mm. The rotating speed of the transfer belt 21 is set to about 400 mm/s in the present example.

As shown in FIG. 5, the transfer belt 21 is composed of a conductive layer 21*p* and an anisotropic conductive layer 21*q* formed on the conductive layer 21*p*. The dimensions of the transfer belt 21, although varying among the actual designs, are for instance 343 mm in inner circular length, 330 mm in width and 0.4 mm in thickness.

A transfer bias of, for example, −700 V is applied to the transfer bias roller 22 by a transfer bias power supply device 25 with, for example, constant voltage control. The toner 2 is transferred by the electric field formed by the transfer bias. In other words, in the present example, a transfer bias application section is composed of the transfer bias roller 22 and the transfer bias power supply device 25. The transfer bias is not limited to the above value, and a vibration bias may be applied instead. The driving roller 23 and the auxiliary roller 24 are disposed in an electrically floating state.

At the transfer position of the transfer belt 21 oppositely facing the photosensitive drum 1, the transfer bias applied by the transfer bias power supply device 25 has an effect on the transfer bias roller 22. As the transfer bias is applied between the photosensitive drum 1 and the transfer bias roller 22, a bias of the same strength as that of the transfer bias applied to the transfer bias roller 22 is also applied to the conductive layer 21*p* and the conductive member 21*b* of the transfer belt 21 that is in contact with the transfer bias roller 22.

In such a state, the transfer electric field contributing to transfer is formed not only by the transfer bias roller 22 but also by the conductive layer 21*p* of the transfer belt 21 that is in contact with the transfer bias roller 22 and by the conductive members 21*b* of the anisotropic conductive layer 21*q* having anisotropic conductance. The anisotropic conductive layer 21*q* of the transfer belt 21, used here, is such a type that the longitudinal direction of the conductive members 21*b* conforms to the thickness direction of the anisotropic conductive layer 21*q*.

When the conductive member 21*b* that is in contact with the transfer bias roller 22 receives the transfer bias from the transfer bias roller 22, the conductive member 21*b* applies the transfer bias to the backside (the side that is in contact with the transfer belt 21) of the transfer sheet 3 at the transfer position. If the conductive members 21*b* are properly arranged, the transfer bias has an effect only on a portion approximately corresponding to the nip width where the transfer belt 21 contacts with the transfer bias roller 22. Then, the toner 2 in the portion that is in contact with the transfer belt 21 and the photosensitive drum 1 in the portion corresponding to the nip width is transferred from the photosensitive drum 1 onto the transfer sheet 3 by the effect of the transfer electric field.

The transfer sheet 3 onto which the toner 2 has been transferred is transported in the paper transporting direction (the direction indicated by the arrow B) to the fixing device (not shown), while being attracted onto the transfer belt 21 by the effect of, for instance, the insulating member 21*a* that is partially dielectrically polarized. When transported to the fixing device, the transfer sheet 3 on the transfer belt 21 is detached from the transfer belt 21 due to the curvature of a portion where the transfer belt 21 is supported by the driving roller 23. In the present example, since the transfer belt 21 is configured so that the anisotropic conductive layer 21*q* is formed on the conductive layer 21*p*, the electric field is applied across the transfer belt 21 in an area out of the neighborhood of the transfer bias roller 22, enabling the transfer sheet 3 to be efficiently attracted.

As described above, since the conductive layer 21*p* is formed so as to contact with the anisotropic conductive layer 21*q* of the transfer belt 21 on the inner circular surface thereof, the transfer device can apply an electric field across the transfer belt 21 in an area out of the transfer area. Therefore, the transfer sheet 3 transported on the transfer belt 21 can be electrostatically attracted onto the transfer belt 21, improving the transportability. Besides, since the transfer bias roller 22 to which the transfer bias is applied is located at the center of the transfer belt 21, the transfer sheet 3 can be more easily inserted to the transfer area, improving the transportability of the transfer sheet 3.

THIRD EXAMPLE

Figure 9:
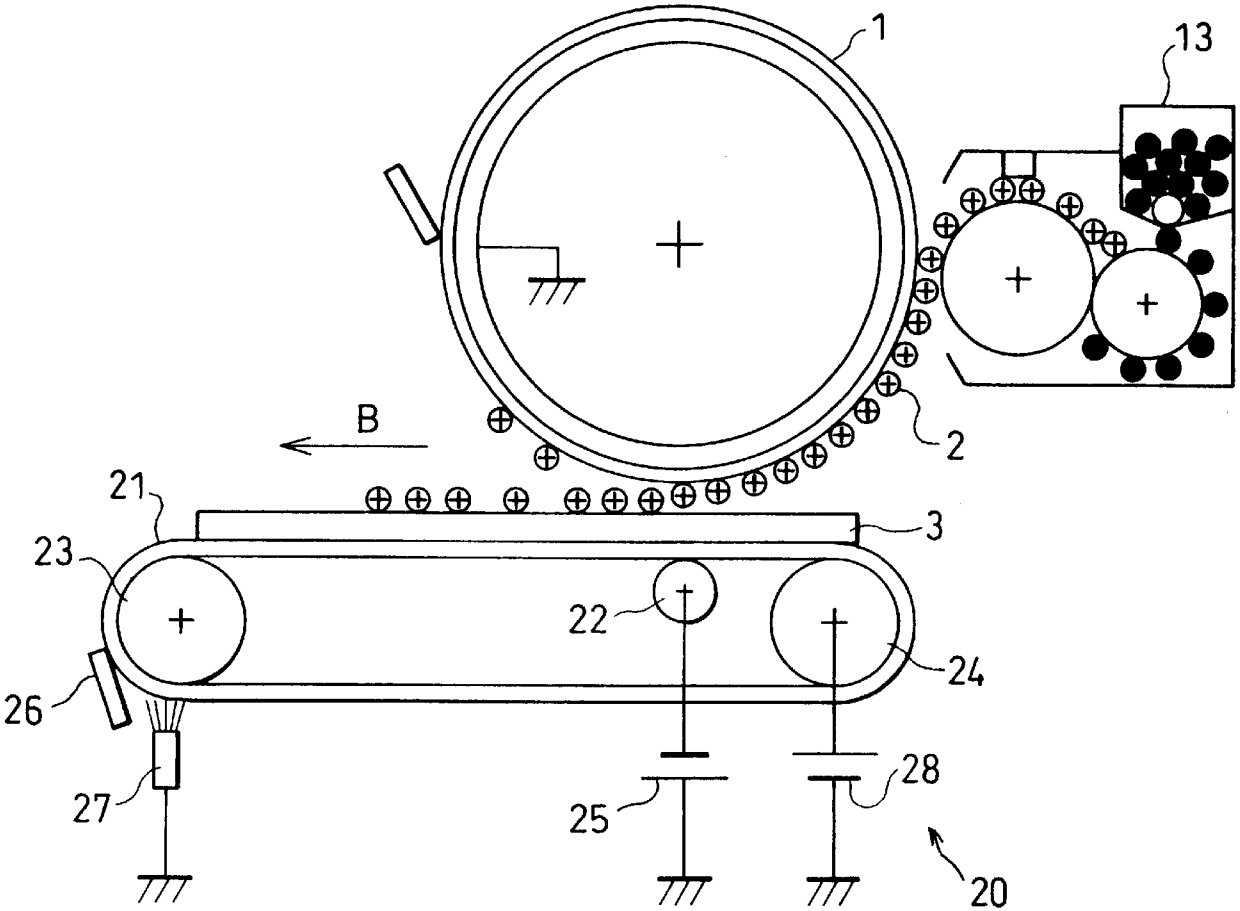
FIG. 9 is a view schematically showing a configuration of a transfer device of a third example.

FIG. 9 schematically shows a configuration of a transfer device of the third example. Since the transfer device 20 of the present example has the same basic operations, configuration, etc. as in the first and second examples, description thereof is omitted. The following description will focus on a feature configuration.

The transfer device shown in FIG. 9 includes the transfer bias roller 22, to which the transfer bias is applied, located almost right beneath the position where the transfer belt 21 contacts with the photosensitive drum 1 via the transfer sheet 3. The driving roller 23 and the auxiliary roller 24 both measure 15 mm in diameter and 328 mm in length. The transfer bias roller 22 measures 6 mm in diameter. Each of these rollers i s provided with a shaft by which it i s supported.

The shaft interval between the shafts of the driving roller 23 and the auxiliary roller 24 is 145 mm. The transfer belt 21 is disposed to stretch between the driving roller 23 and the auxiliary roller 24. The interval between the auxiliary roller 24 and the transfer bias roller 22 is about 30 mm. The rotating speed of the transfer belt 21 is set to about 175 mm/s in the present example.

The transfer belt 21 shown in FIG. 3 is used in the same manner as in the first example. The dimensions of the transfer belt 21, although varying among the actual designs, are for instance 337 mm in inner circular length, 330 mm in width and 0.5 mm in thickness.

A transfer bias of, for example, −1 kV is applied to the transfer bias roller 22 by a transfer bias power supply device 25 with, for example, constant voltage control. The toner 2 is transferred by the electric field formed by the transfer bias. In other words, in the present example, a transfer bias application section is composed of the transfer bias roller 22 and the transfer bias power supply device 25. The auxiliary roller 24 is connected to a first supplementary bias power supply device 28 (first supplementary voltage application section) which applies to the auxiliary roller 24 a bias voltage (hereinafter will be referred to as a first supplementary bias) of the same polarity to the toner 2, for example, +200 V. The transfer bias, the first supplementary bias, etc. are not limited to the above values, and any arbitrary bias may be applied. Besides, a vibration bias may be applied as the transfer bias.

At the transfer position of the transfer belt 21 oppositely facing the photosensitive drum 1, the transfer bias applied by the transfer bias power supply device 25 has an effect on the transfer bias roller 22. As the transfer bias is applied between the photosensitive drum 1 and the transfer bias roller 22, a bias of the same strength as that of the transfer bias applied to the transfer bias roller 22 is also applied to the conductive member 21*b* of the transfer belt 21 that is in contact with the transfer bias roller 22.

In such a state, the transfer electric field contributing to transfer is formed not only by the transfer bias roller 22 but also by the conductive member 21*b* of the transfer belt 21 that is in contact with the transfer bias roller 22.

Meanwhile, the first supplementary bias applied to the auxiliary roller 24 by the first supplementary bias power supply device 28 can prevent toner projection of the toner 2 toward the transfer sheet 3 at a paper inserting portion formed by the photosensitive drum 1 and the transfer belt 21 because of the repulsion of electric charges of the same polarity, since the first supplementary bias is of the same polarity to the toner 2.

That is, transfer of the toner 2 is prevented in an area on the paper insertion side of the transfer area on the transfer belt 21, since the first supplementary bias of the same polarity to the toner 2 is applied, and repulsion of electric charges of the same polarity occurs between the toner 2 and the transfer belt 21 due to this first supplementary bias. Therefore, toner projection of the toner 2 can be prevented.

As described above, the transfer device of the present example applies, using the auxiliary roller 24, a bias of the opposite polarity to the transfer bias to a segment of the transfer belt 21, that is upstream from the transfer bias roller 22 with respect to its transport direction. Therefore, projection of the toner 2 that are charged fine particles can be prevented in a portion where the transfer sheet 3 is inserted into the transfer area. Different electric fields can be applied across the transfer belt 21 in this manner, since the transfer belt 21 has insulation in the belt surface directions.

FOURTH EXAMPLE

Figure 10:
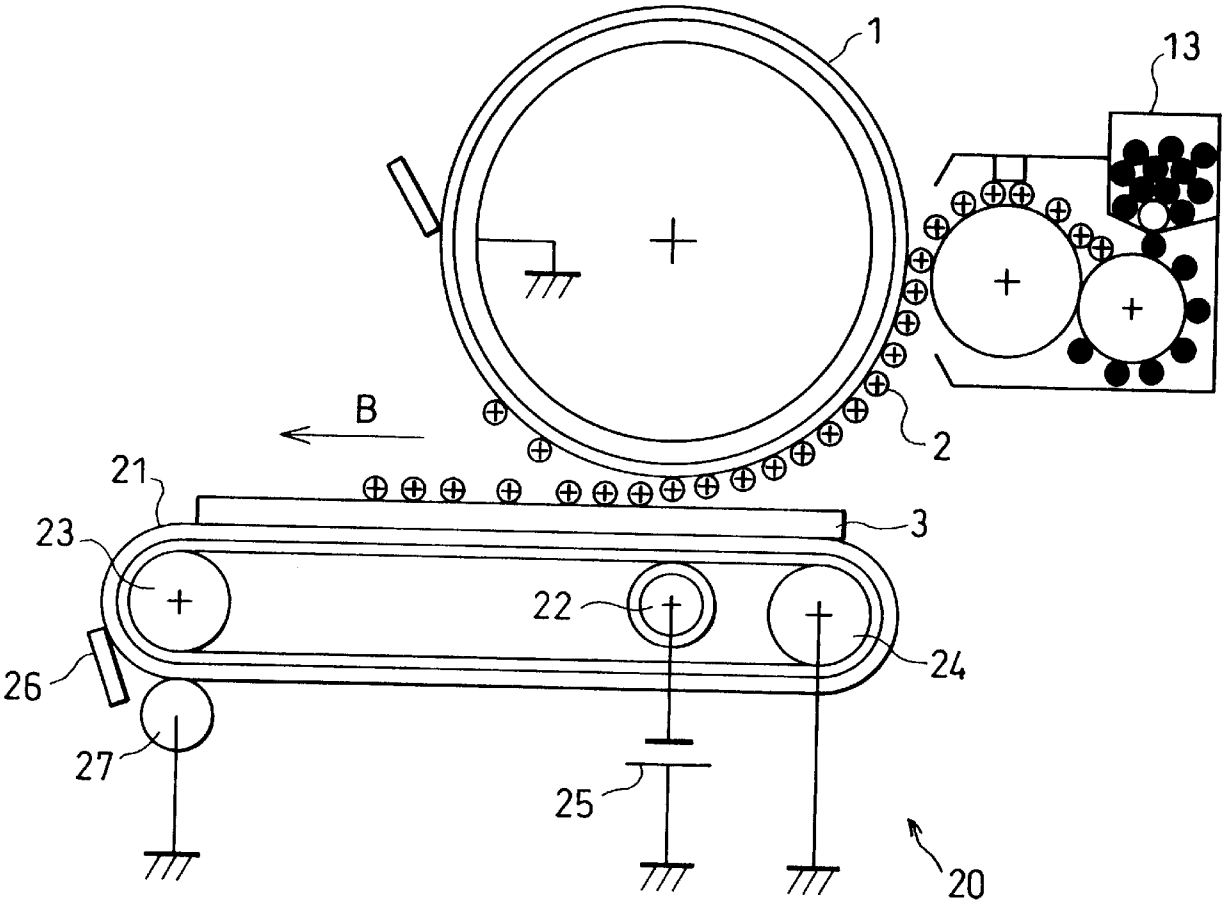
FIG. 10 is a view schematically showing a configuration of a transfer device of a fourth example.

FIG. 10 schematically shows a configuration of a transfer device of the fourth example.

Since the transfer device has the same basic operations, configuration, etc. as in the first to third examples, description thereof is omitted. The following description will focus on features in accordance with the present invention.

The transfer device shown in FIG. 10 includes the transfer bias roller 22, to which the transfer bias is applied, located right beneath the position where the transfer belt 21 contacts with the photosensitive drum 1 via the transfer sheet 3. The driving roller 23 and the auxiliary roller 24 both measure 16 mm in diameter and 335 mm in length. As for the transfer bias roller 22, a dielectric layer 22*a* (see FIG. 4) of, for example, polyethylene terephthalate having a thickness of 100 μm is formed on an aluminum sleeve 22*b* (see FIG. 4) having a diameter of 7 mm.

The shaft interval between the shafts of the driving roller 23 and the auxiliary roller 24 is 160 mm. The transfer belt 21 is disposed to stretch in the interval between the driving roller 23 and the auxiliary roller 24. The interval between the auxiliary roller 24 and the transfer bias roller 22 is about 40 mm. The rotating speed of the transfer belt 21 is set to about 400 mm/s in the present example.

The transfer belt 21 shown in FIG. 5 is used in the same manner as in the second example. The dimensions of the transfer belt 21, although varying among the actual designs, are for instance 370 mm in inner circular length, 335 mm in width and 0.5 mm in thickness.

A transfer bias of, for example, −800 V is applied to the transfer bias roller 22 by a transfer bias power supply device 25 with, for example, constant voltage control. The toner 2 is transferred by the electric field formed by the transfer bias induced on the dielectric layer 22*a*. In other words, in the present example, a transfer bias application section is composed of the transfer bias roller 22 and the transfer bias power supply device 25.

At the transfer position of the transfer belt 21 oppositely facing the photosensitive drum 1, the transfer bias applied by the transfer bias power supply device 25 has an effect on the transfer bias roller 22. As the transfer bias is applied between the photosensitive drum 1 and the transfer bias roller 22, a bias of the same strength as that of the transfer bias applied to the transfer bias roller 22 is also applied to the conductive layer 21*p* and the conductive member 21*b* of the transfer belt 21 that is in contact with the transfer bias roller 22.

In such a state, the transfer electric field contributing to transfer is formed not only by the transfer bias roller 22 but also by the conductive layer 21*p* of the transfer belt 21 that is in contact with the transfer bias roller 22 and that has anisotropic conductance and by the conductive members 21*b* of the transfer belt 21.

Figure 11:
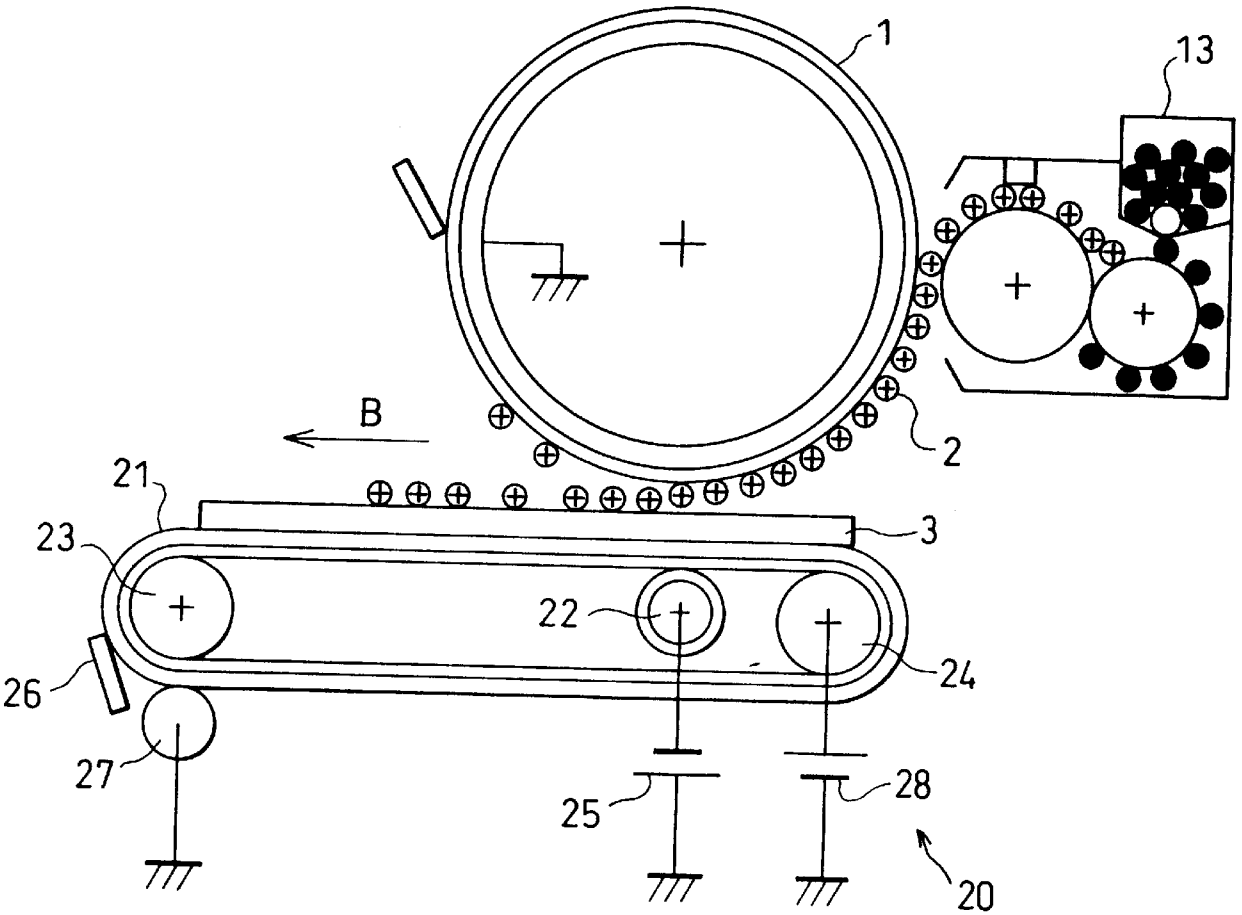
FIG. 11 is a view schematically showing another configuration of a transfer device of the fourth example.

The auxiliary roller 24 is in an electrically floating state in the second example. However, in the present example, the auxiliary roller 24 is grounded. Alternatively a first supplementary bias of, for example, +100 V is applied to the auxiliary roller 24 by the first supplementary bias power supply device 28 as shown in FIG. 11. The first supplementary bias applied to the auxiliary roller 24 by the first supplementary bias power supply device 28 can prevent toner projection of the toner 2 toward the transfer sheet 3 at a paper inserting portion formed by the photosensitive drum 1 and the transfer belt 21 because of the repulsion of electric charges of the same polarity, since the first supplementary bias is of the same polarity to the toner 2. Besides, if a dielectric layer 22*a* is formed on the surface of the transfer bias roller 22, when an excessive current flows for some reason, the dielectric layer 22*a* functions as a protection layer, thereby improving the safety of the transfer device. The transfer bias, the first supplementary bias, etc. are not limited to the above values, and any arbitrary bias may be applied. Besides, a vibration bias may be applied as the transfer bias.

FIFTH EXAMPLE

Figure 12:
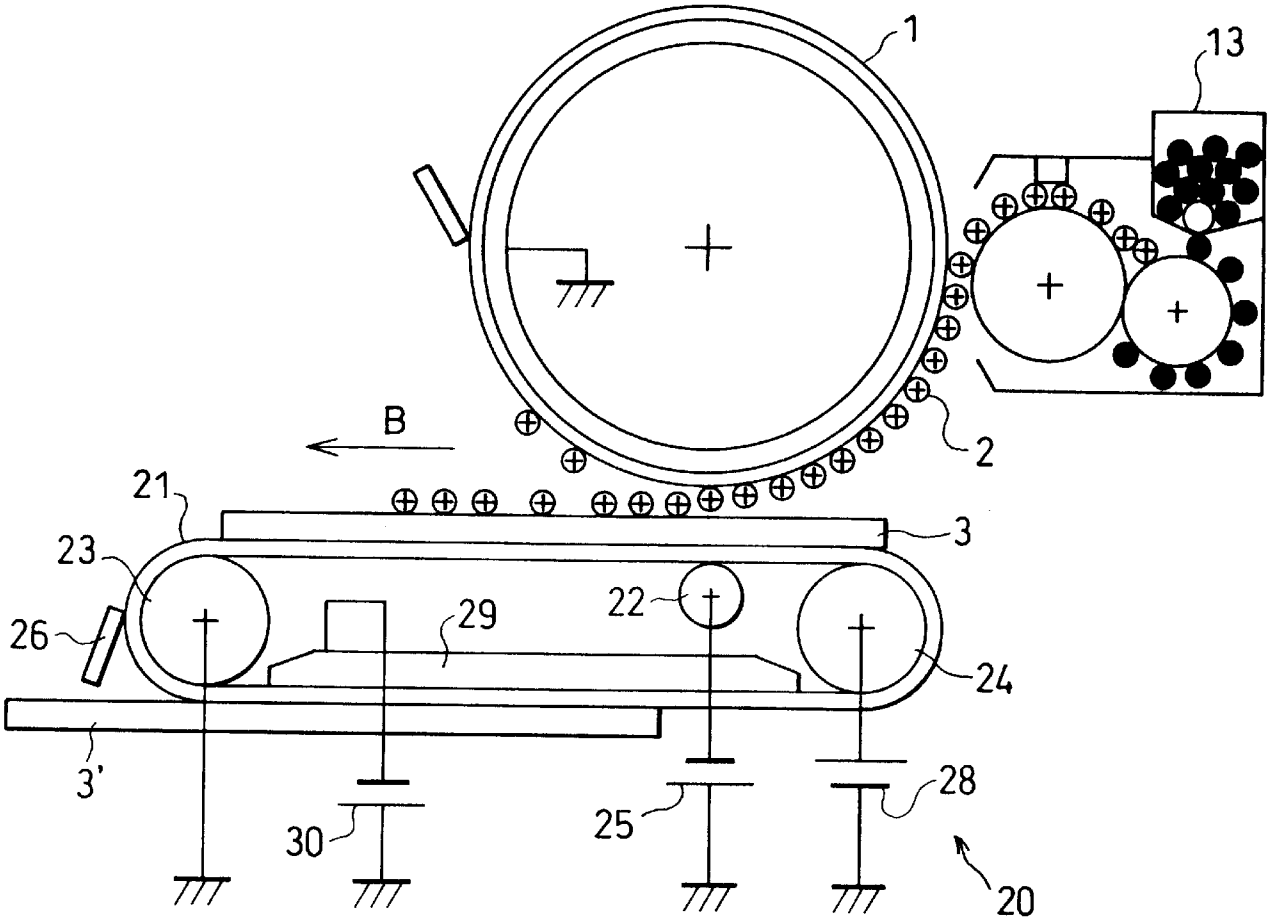
FIG. 12 is a view schematically showing a configuration of a transfer device of a fifth example.

FIG. 12 schematically shows a configuration of a transfer device of the fifth example.

Since the transfer device has the same basic operations, configuration, etc. as in the first to fourth examples, description thereof is omitted. The following description will focus on features in accordance with the present invention.

The transfer device shown in FIG. 12 includes the transfer bias roller 22, to which the transfer bias is applied, located almost right beneath the position where the transfer belt 21 contacts with the photosensitive drum 1 via the transfer sheet 3. The driving roller 23 and the auxiliary roller 24 both measure 15 mm in diameter and 328 mm in length. The transfer bias roller 22 measures 4 mm in diameter.

In addition, the transfer device of the present example includes a paper transporting contact electrode 29, that is a contact electrode, provided so as to be in contact with the back surface (inner circular surface) of the lower portion (portion not facing the photosensitive drum 1) of the transfer belt 21. A second supplementary bias power supply device 30 applies a second supplementary bias to the paper transporting contact electrode 29. That is, a second supplementary voltage application section is composed of the paper transporting contact electrode 29 and the second supplementary bias power supply device 30.

The shaft interval between the shafts of the driving roller 23 and the auxiliary roller 24 is 145 mm. The transfer belt 21 is disposed to stretch in the interval between the driving roller 23 and the auxiliary roller 24. The interval between the auxiliary roller 24 and the transfer bias roller 22 is about 30 mm. The rotating speed of the transfer belt 21 is set to about 300 mm/s in the present example.

The transfer belt 21 shown in FIG. 3 is used. The dimensions of the transfer belt 21, although varying among the actual designs, are for instance 337 mm in inner circular length, 330 mm in width and 0.5 mm in thickness.

A transfer bias of, for example, −1 kV is applied to the transfer bias roller 22 by a transfer bias power supply device 25 with, for example, constant voltage control. The toner 2 is transferred by the electric field formed by the transfer bias. In other words, in the present example, a transfer bias application section is composed of the transfer bias roller 22 and the transfer bias power supply device 25. The auxiliary roller 24 is connected to a first supplementary bias power supply device 28 which applies to the auxiliary roller 24 a bias voltage (hereinafter will be referred to as a first supplementary bias) of the same polarity to the toner 2, for example, +150 V. The transfer bias, the first supplementary bias, etc. are not limited to the above values, and any arbitrary bias may be applied. Besides, a vibration bias may be applied as the transfer bias.

At the transfer position of the transfer belt 21 oppositely facing the photosensitive drum 1, the transfer bias has an effect, and a bias of the same strength as that of the transfer bias applied to the auxiliary roller 24 is also applied to the conductive member 21*b* of the transfer belt 21 that is in contact with the auxiliary roller 24. In such a state, the transfer electric field contributing to transfer is formed not only by the transfer bias roller 22 but also by the conductive member 21*b* of the transfer belt 21 that is in contact with the transfer bias roller 22 and that has anisotropic conductance.

The transfer sheet 3 onto which the toner has been transferred is transported in the paper transporting direction (the direction indicated by the arrow B) and enters the fixing device (not shown), while being attracted onto the transfer belt 21 by the effect of, for instance, an insulating member 21*a* that is partially dielectrically polarized. When entering the fixing device, the transfer sheet 3 on the transfer belt 21 is detached from the transfer belt 21 due to the curvature of a portion where the transfer belt 21 is supported by the driving roller 23. In the present example, the driving roller 23 is grounded. However, in order to further enhance the effects of separation and removal of the residual electric charges, a weak detaching bias of the opposite polarity to the transfer bias may be applied to the driving roller 23 by another bias power supply device.

The first supplementary bias applied to the auxiliary roller 24 by the first supplementary bias power supply device 28 can prevent toner projection of the toner 2 toward the transfer sheet 3 at a paper inserting portion formed by the photosensitive drum 1 and the transfer belt 21 because of the repulsion of electric charges of the same polarity, since the first supplementary bias is of the same polarity to the toner 2.

As described above, the lower portion of the transfer belt 21 is in contact with the paper transporting contact electrode 29 to which a second supplementary bias is applied. As a post-fixing transfer sheet 3' is brought closer to the lower portion of the transfer belt 21, the post-fixing transfer sheet 3' is electrostatically attracted onto the lower portion of the transfer belt 21 by the effect of the second supplementary bias and transported again to the paper inserting side. Thereafter, double-side copying operations can be done by turning over the post-fixing transfer sheet 3' and executing the image forming processes again. As for the double-side copying operations, the post-fixing transfer sheet 3' may be turned over either before or after the transportation by the transfer belt 21. The detachment of the post-fixing transfer sheet 3' from the transfer belt 21 may be done through the separation due to the curvature and through the separation due to the repulsion, since the first supplementary bias is of the opposite polarity to the second supplementary bias.

As described above, by applying the second supplementary bias voltage to the paper transporting contact electrode 29, sheet transportation of the post-fixing transfer sheet 3' can be simultaneously done. That is, the second supplementary bias of the same polarity as the transfer bias applied to the transfer belt 21 by the transfer bias roller 22 is given to the transfer belt 21. Therefore, this bias can attract the transfer sheet 3' onto, for example, the transfer belt 21 on the backside of the transfer area, simplifying the configuration of the transportation system for transporting the transfer sheet 3' to the transfer area in, for example, doubleside printing.

SIXTH EXAMPLE

Figure 13:
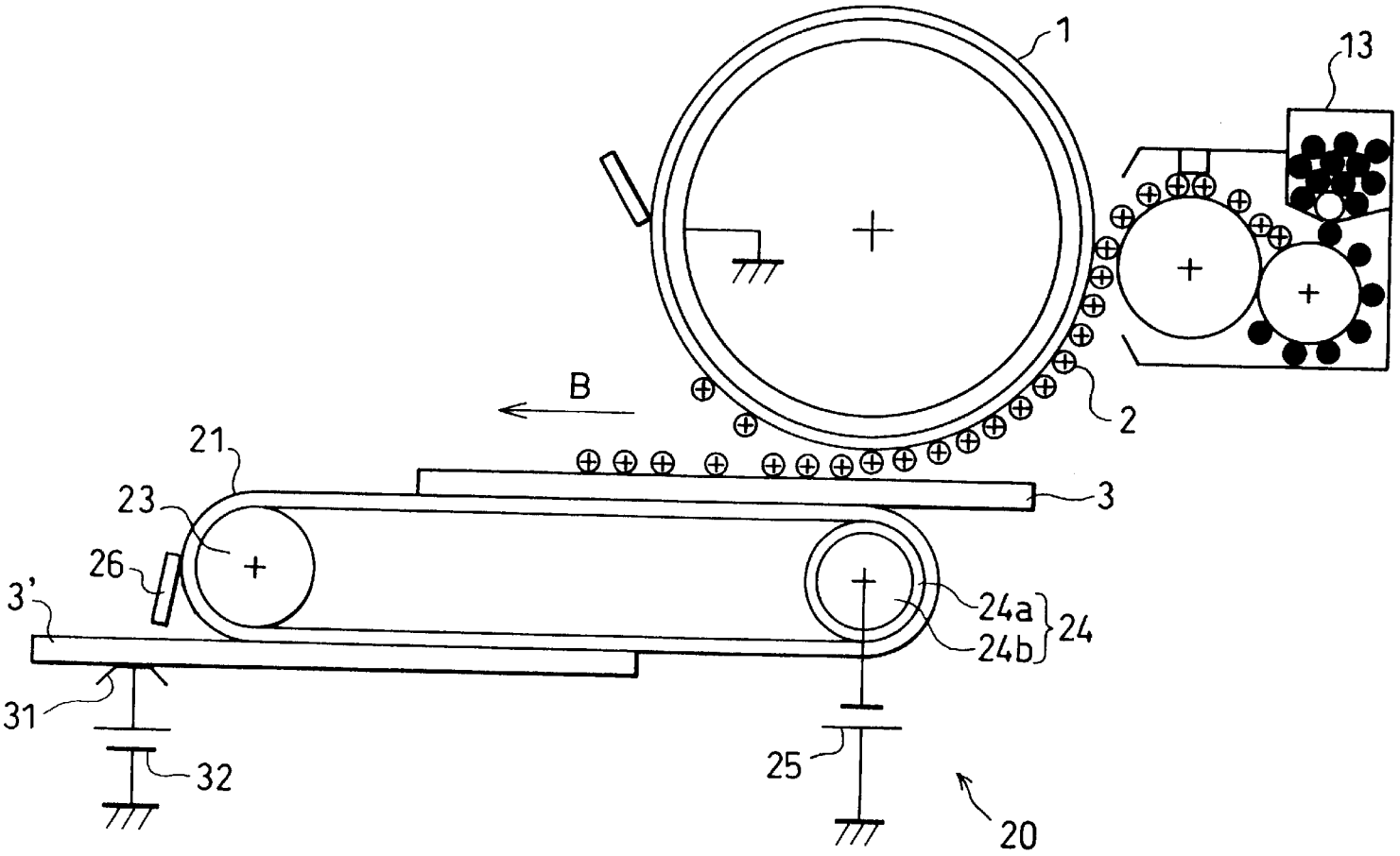
FIG. 13 is a view schematically showing a configuration of a transfer device of a sixth example.
Figure 14:
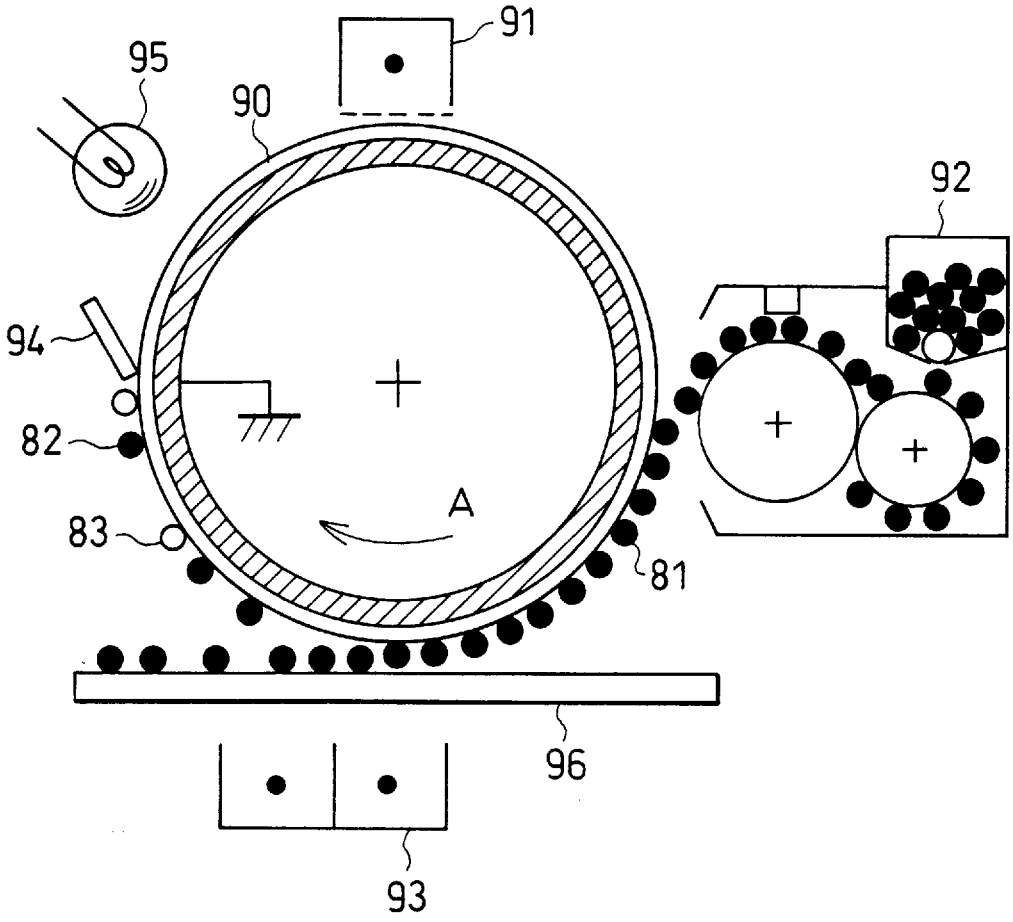
FIG. 14 is a view schematically showing a configuration of a transfer section of a conventional image forming apparatus.
Figure 15:
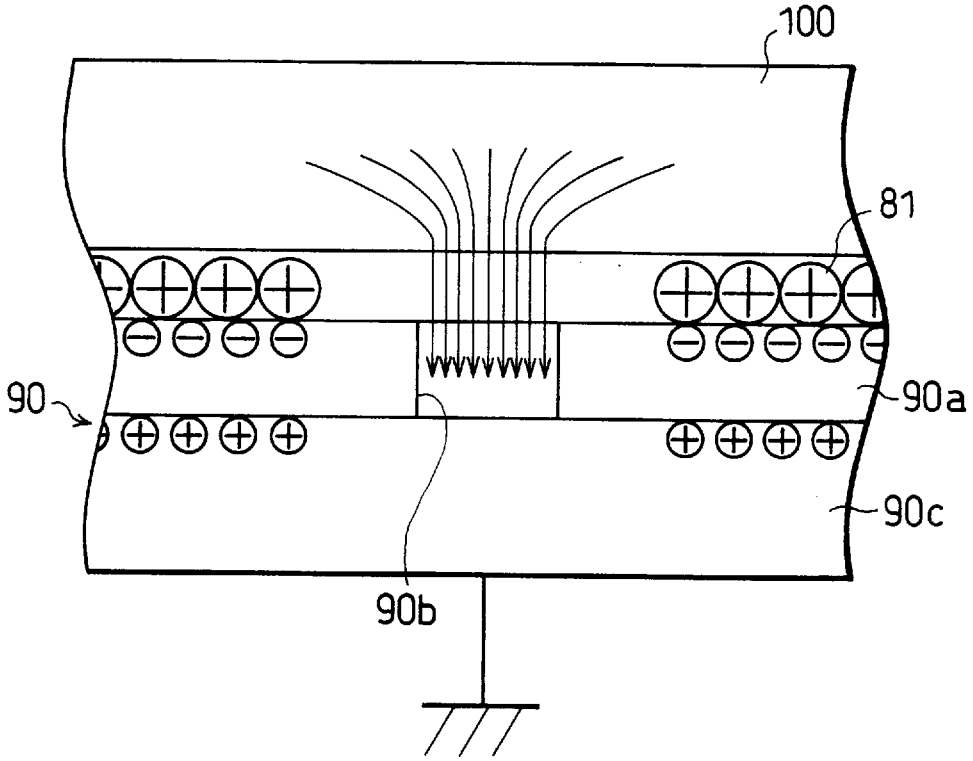
FIG. 15 is eplanatory view showing a pin-hole, at a transfer position, through which electric charge is flowing.
Figure 16:
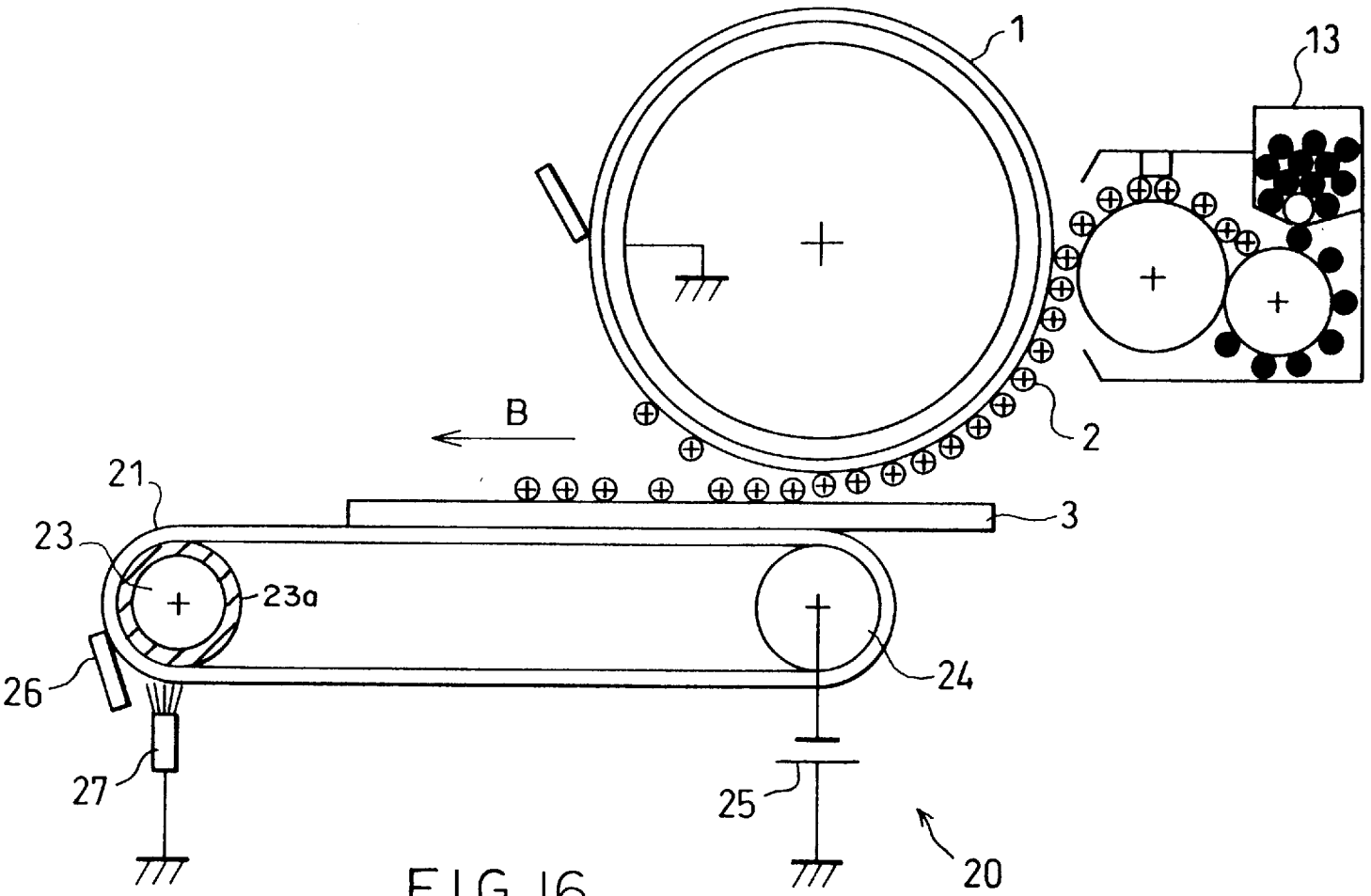
FIG. 16 is a another view as in FIG. 6, illustrating the elastic layer 23*a* on the second roller.

FIG. 13 schematically shows a configuration of a transfer device of the sixth example.

Since the transfer device has the same basic operations, configuration, etc. as in the above-described examples, description thereof is omitted. The following description will focus on features in accordance with the present invention.

The transfer device shown in FIG. 13 includes the auxiliary roller 24, to which the transfer bias is applied, located almost right beneath the position where the transfer belt 21 contacts with the photosensitive drum 1 via the transfer sheet 3. The driving roller 23 and the auxiliary roller 24 both measure 16 mm in diameter and 335 mm in length. As for the auxiliary roller 24, a dielectric layer 24*a* of, for example, polyethylene terephthalate having a thickness of 100 $\mu$m is formed on an aluminum sleeve 24*b* having a diameter of 16 mm.

In addition, the transfer device of the present example includes a paper preliminary charging member 31, via which a third supplementary bias power supply device 32 applies a third supplementary bias to the transfer sheet 3'. That is, a third supplementary voltage application section is composed of the paper preliminary charging member 31 and the third supplementary bias power supply device 32.

The shaft interval between the shafts of the driving roller 23 and the auxiliary roller 24 is 160 mm. The transfer belt 21 is disposed to stretch in the interval between the driving roller 23 and the auxiliary roller 24. The rotating speed of the transfer belt 21 is set to about 400 mm/s in the present example.

The transfer belt 21 shown in FIG. 3 is used. The dimensions of the transfer belt 21, although varying among the actual designs, are for instance 370 mm in inner circular length, 335 mm in width and 0.5 mm in thickness.

A transfer bias of, for example, −800 V is applied to the auxiliary roller 24 by a transfer bias power supply device 25 with, for example, constant voltage control. The toner 2 is transferred by the electric field formed by the transfer bias induced on the dielectric layer 24*a*. In other words, in the present example, a transfer bias application section is composed of the auxiliary roller 24 and the transfer bias power supply device 25.

At the transfer position of the transfer belt 21 oppositely facing the photosensitive drum 1, the transfer bias has an effect, and a bias of the same strength is also applied to the conductive member 21*b* of the transfer belt 21 that is in contact with the auxiliary roller 24. In such a state, the transfer electric field contributing to transfer is formed not only by the auxiliary roller 24 but also by the conductive member 21*b*.

The paper preliminary charging member 31 is disposed on the paper ejection side of the lower portion of the transfer belt 21 so that the third supplementary bias power supply device 32 preliminarily charges the transfer sheet 3' (e.g., the transfer paper 3 after fixing) with a third supplementary bias applied. As the transfer sheet 3' preliminarily charged with the third supplementary bias is brought closer to the lower portion of the transfer belt 21, the transfer sheet 3' after fixing is electrostatically attracted by the transfer belt 21 and the electric charges supplied by the effect of the third supplementary bias, and transported to the paper inserting side. Thereafter, double-side copying operations can be done by turning over the transfer sheet 3' after fixing and executing the image forming processes again. As for the double-side copying operations, the transfer sheet 3' after fixing may be turned over either before or after the transportation by the transfer belt 21. The detachment of the transfer sheet 3' after fixing from the transfer belt 21 may be done through the separation due to the curvature and through the separation due to the repulsion, since the transfer bias applied to the auxiliary roller 24 is of the opposite polarity to the third supplementary bias.

As described above, by applying the third supplementary bias to the transfer sheet 3', a transfer sheet, etc. after fixing can be transported by the lower portion of the transfer belt 21 to the transfer position of the toner 2 in the direction opposite to the transport direction in normal image forming. Consequently, it is possible to simplify the transportation system of the transfer sheet 3'. That is, the configuration of the transportation system for transporting the transfer sheet 3' to the transfer area in, for example, double-side printing can be simplified by giving a bias of the opposite polarity to the transfer bias to the transfer sheet 3' and attracting the transfer sheet 31 onto, for example, the transfer belt 21 on the backside of the transfer area.

Besides, here, the transfer belt 21 shown in FIG. 3 is used. However, any type of transfer belt can be sued as long as it includes an anisotropic conductive layer on its surface that contacts with the transfer sheet. For example, the transfer belt 21 including the conductive layer 21*p* as shown in FIG. 5 can be used instead.

The configurations described in the above examples are mere examples. The effects of forming the transfer belt with the anisotropic conductive layer are retained even if a partial change is made in configuration, such as material, dimension and arrangement. For example, the relative positions of the driving roller, the auxiliary roller, the transfer bias roller may be determined freely as long as they neither cause toner projection nor damage the transfer properties, and the number of the rollers may also vary.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A transfer device, incorporated in an image forming apparatus for forming an image with an electrophotographic method, for transferring an image on an image information forming body onto a transfer material by applying a transfer bias with a transfer bias application section while attracting and transporting the transfer material with a belt member, said belt member being provided with an anisotropic conductive layer that is conductive only in a thickness direction of said belt member and insulating in a direction perpendicular to the thickness direction.

2. The transfer device as defined in claim 1, wherein said belt member is provided on an inner circular surface thereof with a conductive layer that contacts with said anisotropic conductive layer.

3. The transfer device as defined in claim 1, wherein said transfer bias application section is provided with a dielectric layer on a portion thereof where said transfer bias application section contacts with said belt member.

4. The transfer device as defined in claim 1, wherein said belt member is stretched between a first roller and a second roller respectively located upstream and downstream with respect to a transport direction of the transfer material, wherein said transfer bias application section is disposed between the first and second rollers.

5. The transfer device as defined in claim 4, wherein said first roller is provided with a first supplementary voltage application section for applying to said belt member an electric field of a polarity opposite to that of an electric field applied by said transfer bias application section.

6. The transfer device as defined in claim 1, wherein said belt member is stretched between a first roller and a second roller respectively located upstream and downstream with respect to a transport direction of the transfer material, wherein said second roller is a driving roller, provided on a surface thereof with an elastic layer, for driving the belt member.

7. The transfer device as defined in claim 1, wherein said belt member is stretched between a first roller and a second roller respectively located upstream and downstream with respect to a transport direction of the transfer material, including a supplementary voltage application section for applying, to one of two areas of said belt member between said first and second rollers, an electric field of a same polarity as an electric field applied by said transfer bias application section, said transfer bias not being applied to said one of two areas.

8. The transfer device as defined in claim 1, including a supplementary voltage application section for applying to said belt member an electric field of a polarity opposite to that of an electric field applied by said transfer bias application section.

9. The transfer device as defined in claim 1, wherein said anisotropic conductive layer of said belt member is constituted by an insulating member and numerous conductive members, said numerous conductive members being made of conductive material and piercing said insulating member in a thickness direction of said insulating member, wherein said conductive members are disposed in almost a same pitch as a dot pitch of said image formed on the transfer material.

10. The transfer device as defined in claim 1, wherein said anisotropic conductive layer of said belt member is constituted by an insulating member and numerous conductive members, said numerous conductive members being made of conductive material and piercing said insulating member in a thickness direction of said insulating member, wherein a width of an area in which said conductive members are disposed is set to be almost equal to a contact width of said belt member and said transfer bias application section with respect to a transport direction.

11. In an image forming apparatus incorporating a transfer device for transferring an image on an image information forming body onto a transfer material by applying a transfer bias with a transfer bias application section while attracting and transporting the transfer material with a belt member, said belt member being provided with an anisotropic conductive layer that is conductive only in a thickness direction of said belt member and insulating in a direction perpendicular to the thickness direction.

12. The image forming apparatus as defined in claim 11, wherein said belt member is provided on an inner circular surface thereof with a conductive layer that contacts with said anisotropic conductive layer.

13. The image forming apparatus as defined in claim 11, wherein said transfer bias application section is provided with a dielectric layer on a portion thereof where said transfer bias application section contacts with said belt member.

14. The image forming apparatus as defined in claim 11, wherein said belt member is stretched between a first roller and a second roller respectively located upstream and downstream with respect to a transport direction of the transfer material, wherein said transfer bias application section is disposed between the first and second rollers.

15. The image forming apparatus as defined in claim 14, wherein said first roller is provided with a first supplementary voltage application section for applying to said belt member an electric field of a polarity opposite to that of an electric field applied by said transfer bias application section.

16. The image forming apparatus as defined in claim 11, wherein said belt member is stretched between a first roller and a second roller respectively located upstream and downstream with respect to a transport direction of the transfer material, wherein said second roller is a driving roller, provided on a surface thereof with an elastic layer, for driving the belt member.

17. The image forming apparatus as defined in claim 11, wherein said belt member is stretched between a first roller and a second roller respectively located upstream and downstream with respect to a transport direction of the transfer material, including a supplementary voltage application section for applying, to one of two areas of said belt member between said first and second rollers, an electric field of a same polarity as an electric field applied by said transfer bias application section, said transfer bias not being applied to said one of two areas.

18. The image forming apparatus as defined in claim 11, including a supplementary voltage application section for applying to said belt member an electric field of a polarity opposite to that of an electric field applied by said transfer bias application section.

19. The image forming apparatus as defined in claim 11, wherein said anisotropic conductive layer of said belt member is constituted by an insulating member and numerous conductive members, said numerous conductive members being made of conductive material and piercing said insulating member in a thickness direction of said insulating member, wherein said conductive members are disposed in almost a same pitch as a dot pitch of said image formed on the transfer material.

20. The image forming apparatus as defined in claim 11, wherein said anisotropic conductive layer of said belt member is constituted by an insulating member and numerous conductive members, said numerous conductive members being made of conductive material and piercing said insulating member in a thickness direction of said insulating member, wherein a width of an area in which said conductive members are disposed is set to be almost equal to a contact width of said belt member and said transfer bias application section with respect to a transport direction.

21. A transfer device, incorporated in an image forming apparatus for forming an image with an electrophotographic method, for transferring an image on an image information forming body onto a transfer material by applying a transfer bias with a transfer bias application section while attracting and transporting the transfer material with a transportation member, said transportation member being provided with an anisotropic conductive layer that is conductive only in a thickness direction of said transportation member and insulating in a direction perpendicular to the thickness direction.

22. The transfer member of claim 21, wherein said transportation member is a belt member.

* * * * *